US009902174B2

(12) United States Patent
Ishikawa et al.

(10) Patent No.: US 9,902,174 B2
(45) Date of Patent: Feb. 27, 2018

(54) PRINTER

(71) Applicant: FUJITSU COMPONENT LIMITED, Tokyo (JP)

(72) Inventors: Tetsuhiro Ishikawa, Tokyo (JP); Sumio Watanabe, Tokyo (JP); Masahiro Tsuchiya, Tokyo (JP); Tatsuya Oguchi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/496,135

(22) Filed: Apr. 25, 2017

(65) Prior Publication Data

US 2017/0313102 A1 Nov. 2, 2017

(30) Foreign Application Priority Data

Apr. 28, 2016 (JP) ..... 2016-091893

(51) Int. Cl.

| | |
|---|---|
| ***B41J 15/00*** | (2006.01) |
| ***B41J 11/20*** | (2006.01) |
| ***B41J 11/04*** | (2006.01) |
| ***B41J 15/04*** | (2006.01) |

(52) U.S. Cl.

CPC ..... *B41J 11/04* (2013.01); *B41J 11/20* (2013.01); *B41J 15/042* (2013.01)

(58) Field of Classification Search

CPC ..... B41J 15/042; B41J 3/4075

See application file for complete search history.

(56) References Cited

U.S. PATENT DOCUMENTS

| | | | | |
|---|---|---|---|---|
| 5,063,395 | A * | 11/1991 | Nuita | B41J 11/24 347/220 |
| 6,744,457 | B2 | 6/2004 | Seino et al. | |
| 8,585,304 | B2 | 11/2013 | Yokoyama | |
| 2007/0286659 | A1 * | 12/2007 | Yamada | B41J 2/325 400/58 |
| 2008/0068437 | A1 * | 3/2008 | Hirai | B41J 15/042 347/220 |
| 2017/0120644 | A1 * | 5/2017 | Oguchi | B41J 29/13 |
| 2017/0210154 | A1 | 7/2017 | Chiba et al. | |

FOREIGN PATENT DOCUMENTS

| | | | | |
|---|---|---|---|---|
| EP | 2159066 | | 3/2010 | |
| JP | H02-160558 | | 6/1990 | |
| JP | 10235909 | * | 9/1998 | B41J 11/20 |
| JP | 2003-246104 | | 9/2003 | |
| JP | 2007331112 | * | 12/2007 | B41J 2/32 |
| JP | 2008068552 | * | 3/2008 | B41J 2/32 |
| JP | 2009-028910 | | 2/2009 | |
| WO | 2016/013569 | | 1/2016 | |

* cited by examiner

*Primary Examiner* — Huan Tran
(74) *Attorney, Agent, or Firm* — IPUSA, PLLC

(57) ABSTRACT

A printer includes a body configured to accommodate recording paper, a lid attached to the body to be openable and closable relative to the body, a pressing part on the lid, a platen roller attached to the lid, a movable shaft in the body, a spring that urges the movable shaft, and a lever configured to support bearings of the platen roller with the lid being closed. The movable shaft is provided at a position corresponding to the pressing part to be movable in a longitudinal direction of the movable shaft, and is pressed by the pressing part to generate a spring force in the spring during closure of the lid.

7 Claims, 33 Drawing Sheets

PRINTER

CROSS-REFERENCE TO RELATED APPLICATION

The present application is based upon and claims priority to Japanese Patent Application No. 2016-091893, filed on Apr. 28, 2016, the entire contents of which are incorporated herein by reference.

BACKGROUND OF THE INVENTION

1. Field of the Invention

The present invention relates to printers.

2. Description of the Related Art

Printers are widely used for shop registers and automated teller machines (ATMs) or cash dispensers (CDs) in banks.

Some of these printers include, for example, a printer body and a lid pivotably supported on the printer body. The lid is opened to allow a roll of recording paper to be loaded into a paper holder of the printer body.

Reference may be made to, for example, Japanese Patent No. 2585769 and Japanese Laid-Open Patent Application Nos. 2003-246104 and 2009-28910 for related art.

SUMMARY OF THE INVENTION

According to an aspect of the present invention, a printer includes a body configured to accommodate recording paper, a lid attached to the body to be openable and closable relative to the body, a pressing part on the lid, a platen roller attached to the lid, a movable shaft in the body, a spring that urges the movable shaft, and a lever configured to support bearings of the platen roller with the lid being closed. The movable shaft is provided at a position corresponding to the pressing part to be movable in a longitudinal direction of the movable shaft, and is pressed by the pressing part to generate a spring force in the spring during closure of the lid.

According to an aspect of the present invention, a printer includes a body configured to accommodate recording paper, a lid attached to the body to be openable and closable relative to the body, a platen roller attached to the lid, a lever configured to support bearings of the platen roller with the lid being closed, a spring in the body, and a pressing part on the lid. The pressing part is provided at a position corresponding to the spring. The spring is pressed by the pressing part to generate a spring force during closure of the lid.

According to an aspect of the present invention, a printer includes a body configured to accommodate recording paper, a lid attached to the body to be openable and closable relative to the body, a platen roller attached to the lid, a lever configured to support bearings of the platen roller with the lid being closed, and a spring on the lid. The spring includes a first part connected to the lid. The body includes a contact part provided at a position corresponding to a second part of the spring. The second part of the spring is pressed by the contact part to generate a spring force during closure of the lid.

BRIEF DESCRIPTION OF THE DRAWINGS

FIGS. 10A through 100 are diagrams depicting the lid of the printer in a half-lock state;

DESCRIPTION OF THE EMBODIMENTS

Figure 1:
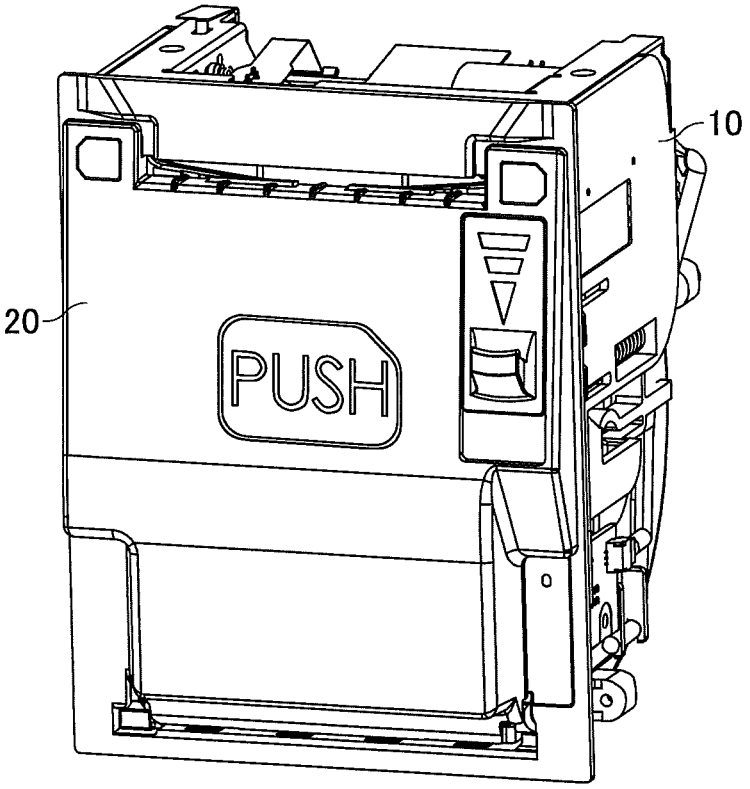
FIG. 1 is a perspective view of a printer with a lid closed.

Printers including a printer body and a lid are also used for information apparatus terminals used by various users, such as ticket machines. When such ticket machines run out of recording paper, a user opens the lid to load a paper holder with recording paper and thereafter closes the lid. When closing the lid, for example, the bearings of a platen roller enter locks provided in the printer body to lock the lid. As a result, the printer becomes ready to perform printing on the recording paper.

In the case where the locks are provided one on each side of the printer, however, it may occur that one of the bearings enters one of the locks while the other of the bearings stops on the way to be out of the other of the locks when the lid is pressed to be closed. Such a state is referred to as a "half-lock" state, in which the platen roller is incorrectly positioned relative to a print head to prevent the printer from performing printing. In this half-lock state, the lid appears to be closed to a user, who may therefore think that printing is not performed although the lid is closed, thus determining that something is wrong with the printer. In order to eliminate the half-lock state, for example, the lid may be pressed on the side on which the other of the locks is provided, or may be opened and closed again. Users, however, are reluctant to perform such operations once determining that the printer is out of order. Therefore, the printer is prevented from performing printing, so that an information apparatus terminal in which the printer is installed becomes out of service.

Therefore, there is a demand for printers in which no half-lock state occurs when closing a lid.

According to a printer of an embodiment of the present invention, the closure of a lid is secured without the occurrence of a half-lock state when the lid is closed.

Embodiments of the present invention are described below with reference to the accompanying drawings. The same elements are referred to using the same reference numeral, and a repetitive description thereof is omitted.

Figure 2:
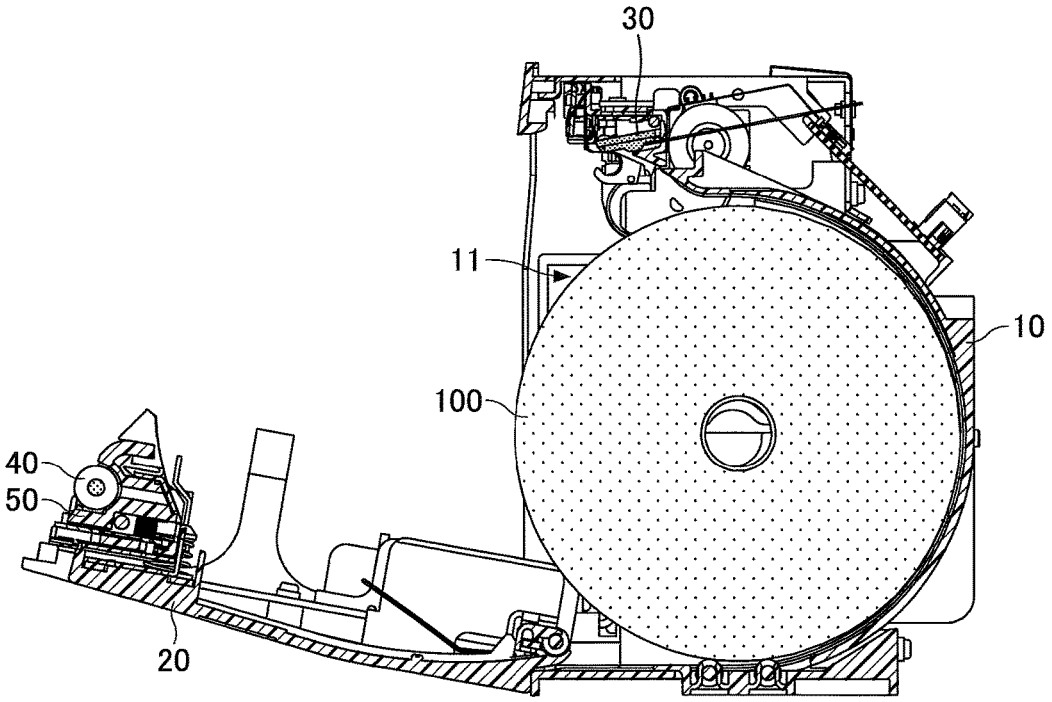
FIG. 2 is a cross-sectional view of the printer with the lid open.
Figure 3:
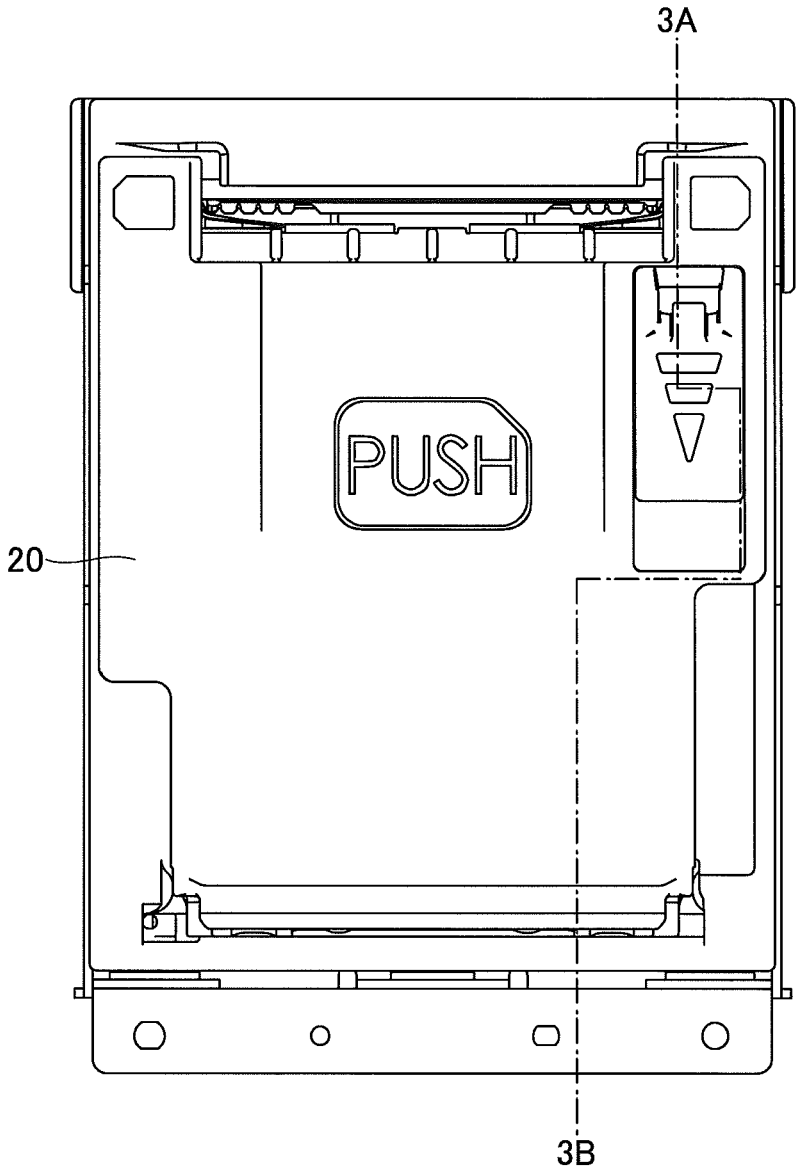
FIG. 3 is a front elevational view of the printer.
Figure 4:
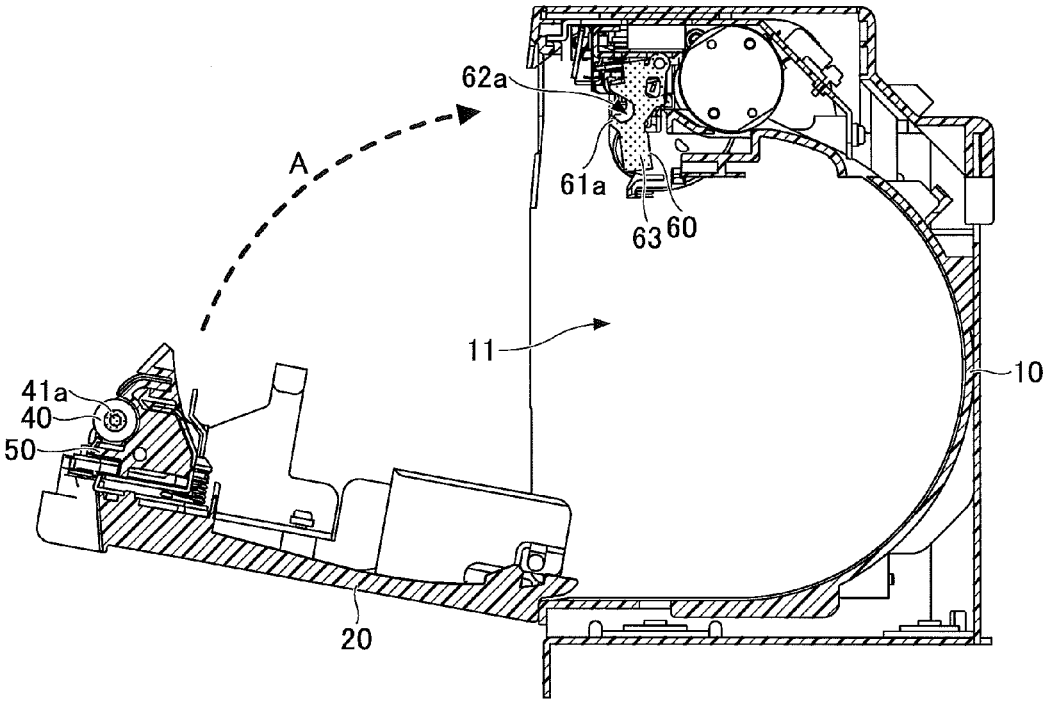
FIG. 4 is a cross-sectional view of the printer with the lid open.
Figure 5:
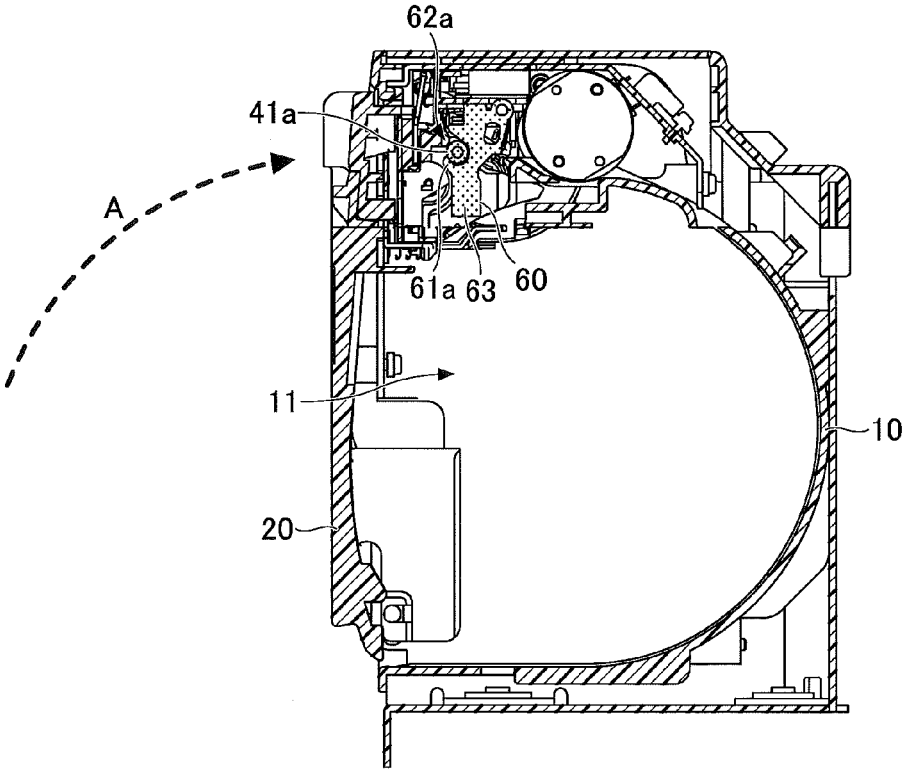
FIG. 5 is a cross-sectional view of the printer with the lid closed.

First, the occurrence of a half-lock state at the time of closing a lid in printers is described with reference to FIGS. 1 through 11. A printer depicted in FIGS. 1 through 11 is a clamshell type, in which a roll of recording paper is dropped to be loaded into a paper holder. FIG. 1 is a perspective view of the printer with a lid closed. FIG. 2 is a cross-sectional view of the printer with the lid open. FIG. 3 is a front elevational view of the printer with the lid closed. FIGS. 4 and 5 are cross-sectional views of the printer taken along the one-dot chain line 3A-3B in FIG. 3, depicting a state where the lid is open and a state where the lid is closed, respectively. The printer is schematically depicted in and may differ in detail among the drawings.

Referring to, for example, FIGS. 1 through 5, the printer includes a body 10 and a lid 20 pivotally attached to the body 10. The body 10 includes a paper holder ("holder") 11 and a print head ("head") 30. The holder 11 accommodates a roll of recording paper 100. A platen roller 40 and a cutter unit 50 for cutting the recording paper 100 are attached to the lid 20.

The recording paper 100 is placed in the holder 11 and then the lid 20 is closed, so that the recording paper 100 is set in the printer. Specifically, the recording paper 100 is placed in the holder 11 with the lid 20 open as depicted in FIG. 4, and thereafter, the lid 20 is pivoted about a shaft in the direction indicated by the dashed arrow A to be closed as depicted in FIG. 5.

Figure 6:
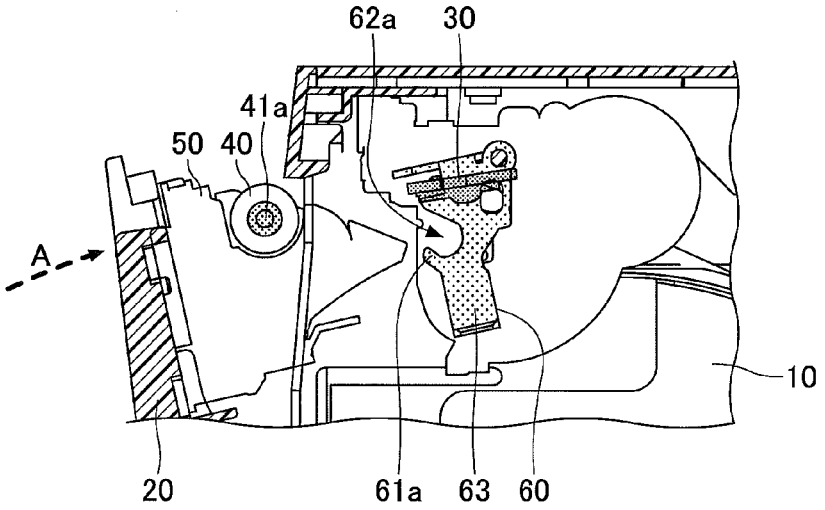
FIG. 6 is a diagram illustrating the closure of the lid of the printer.
Figure 7A:
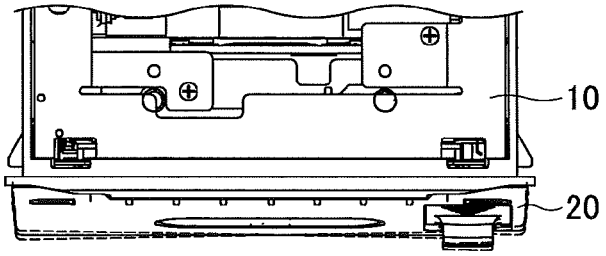
FIGS. 7A through 7C are diagrams depicting the printer with the lid completely closed.
Figure 7B:
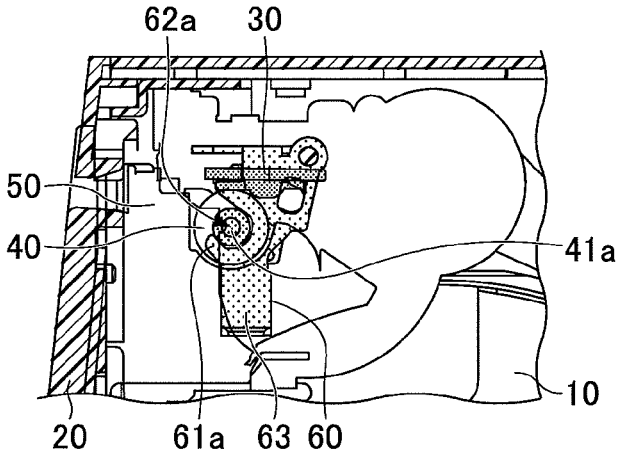
Figure 7C:
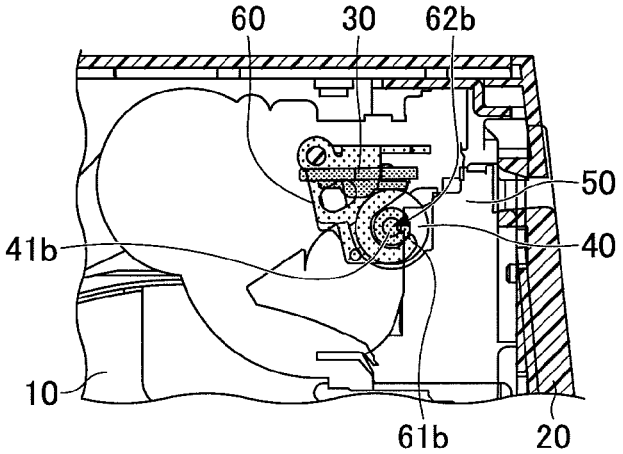

The operation of closing the lid 20 is described in more detail with reference to FIGS. 6 and 7A through 7C. FIG. 6 depicts the printer during the process of closing the lid 20 by pivoting the lid 20 in the direction indicated by the dashed arrow A. FIGS. 7A, 7B and 7C are diagrams depicting the printer in which the lid 20 is completely closed. FIG. 7A is a plan view of the printer. FIGS. 7B and 7C are cross-sectional views of the printer, depicting a cross section near the right end and a cross section near the left end, respectively, of the printer of FIG. 7A.

First and second bearings 41*a* and 41*b* are provided one at each axial end of the platen roller 40. A lock lever ("lever") 60 configured to support and securely lock the first and second bearings 41*a* and 41*b* when the lid 20 is closed is provided in the body 10. The lever 60 includes a first lock 61*a* and a second lock 61*b* at opposite ends. An opening 62*a* that accommodates the first bearing 41*a* is formed in the first lock 61*a*. An opening 62*b* that accommodates the second bearing 41*b* is formed in the second lock 61*b*. The lever 60 includes an operation part 63 at the same end as the first lock 61*a*. The operation part 63 is operated to pivot the lever 60.

As depicted in FIGS. 7A through 7C, when the lid 20 is closed, the first bearing 41*a* and the second bearing 41*b* are accommodated in the opening 62*a* and the opening 62*b*, respectively, to be locked to prevent the lid 20 from opening. Printing is performed on the recording paper 100 with the head 30 with the first and second bearings 41*a* and 41*b* being thus locked.

Figure 8:
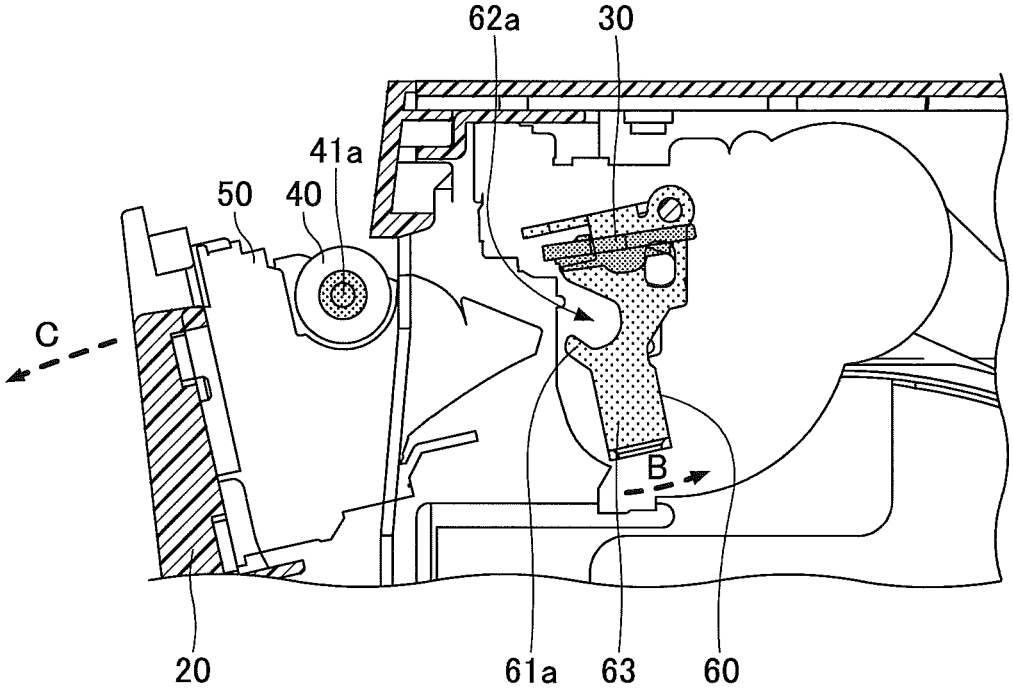
FIG. 8 is a diagram illustrating the opening of the lid of the printer.

When opening the lid 20, the operation part 63 is moved in the direction indicated by the dashed arrow B as depicted in FIG. 8. As a result, the first and second bearings 41*a* and 41*b* exit from the openings 62*a* and 62*b*, respectively, to be unlocked. Accordingly, the lid 20 pivots in the direction indicated by the dashed arrow C to open.

According to this printer, the half-lock state occurs when the first bearing 41*a* or the second bearing 41*b* is out of the opening 62*a* or 62*b*. Specifically, the half-lock state occurs when the second bearing 41*b* stops on the way to be incompletely accommodated in the opening 62*b* while the first bearing 41*a* is accommodated in the opening 62*a* as depicted in FIGS. 9A through 9C (a first half-lock state) or when the first bearing 41*a* stops on the way to be incompletely accommodated in the opening 62*a* while the second bearing 41*b* is accommodated in the opening 62*b* as depicted in FIGS. 10A through 10C (a second half-lock state).

In these states, while one of the first and second bearings 41*a* and 41*b* is accommodated in one of the openings 62*a* and 62*b*, the other of the first and second bearings 41*a* and 41*b* is not accommodated in the other of the openings 62*a* and 62*b* to incorrectly position the platen roller 40 relative to the head 30 to prevent the printer from performing printing. FIG. 9A is a plan view of the printer in the first half-lock state. FIGS. 9B and 9C are cross-sectional views of the printer, depicting a cross section near the right end and a cross section near the left end, respectively, of the printer of FIG. 9A. FIG. 10A is a plan view of the printer in the second half-lock state. FIGS. 10B and 10C are cross-sectional views of the printer, depicting a cross section near the right end and a cross section near the left end, respectively, of the printer of FIG. 10A.

Figure 9A:
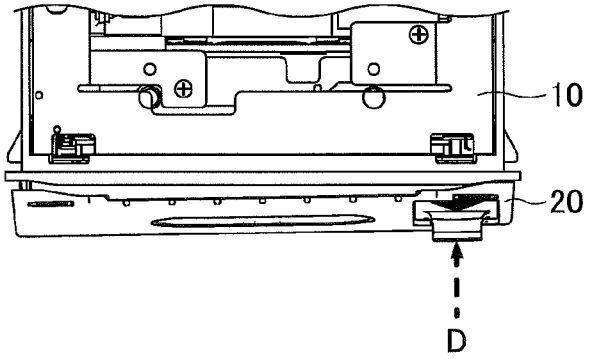
FIGS. 9A through 9C are diagrams depicting the lid of the printer in a half-lock state.
Figure 9B:
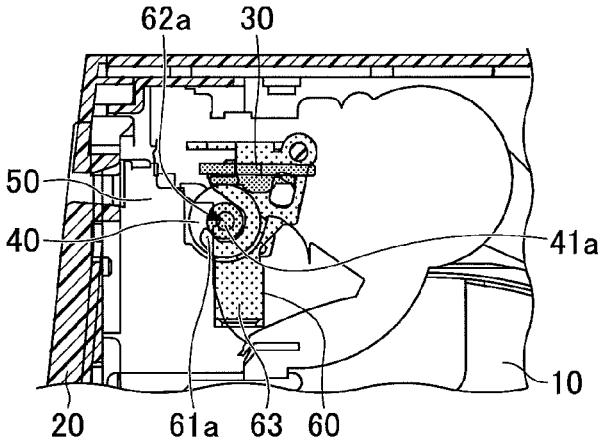
Figure 9C:
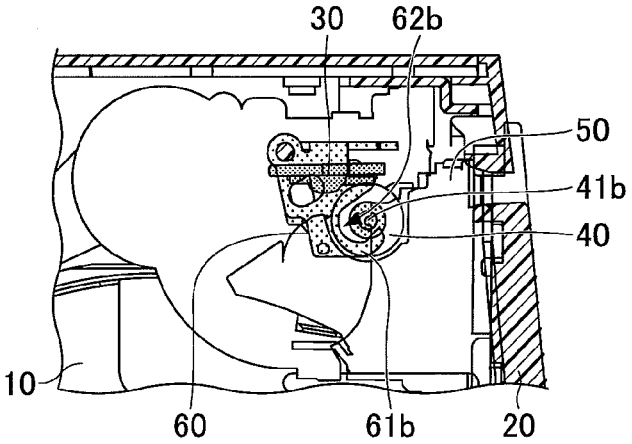
Figure 10A:
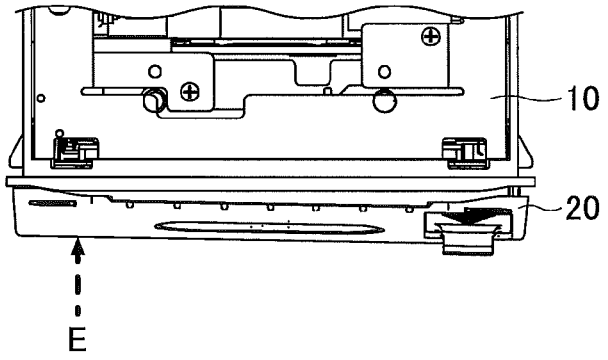
Figure 10B:
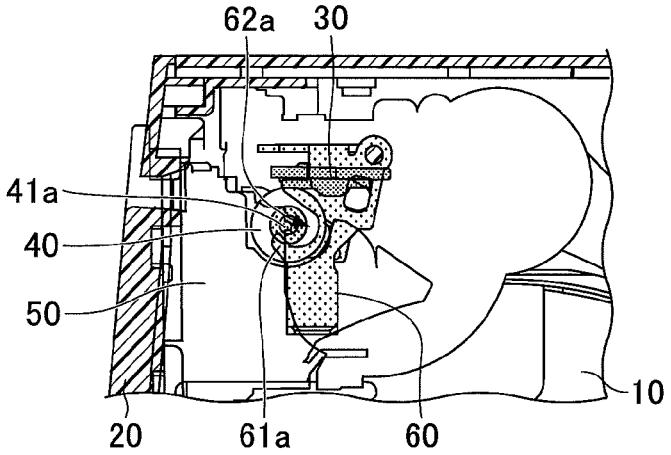
Figure 10C:
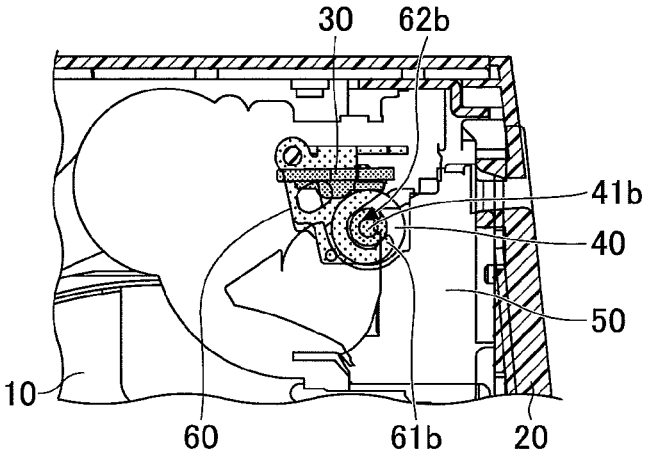
Figure 11:
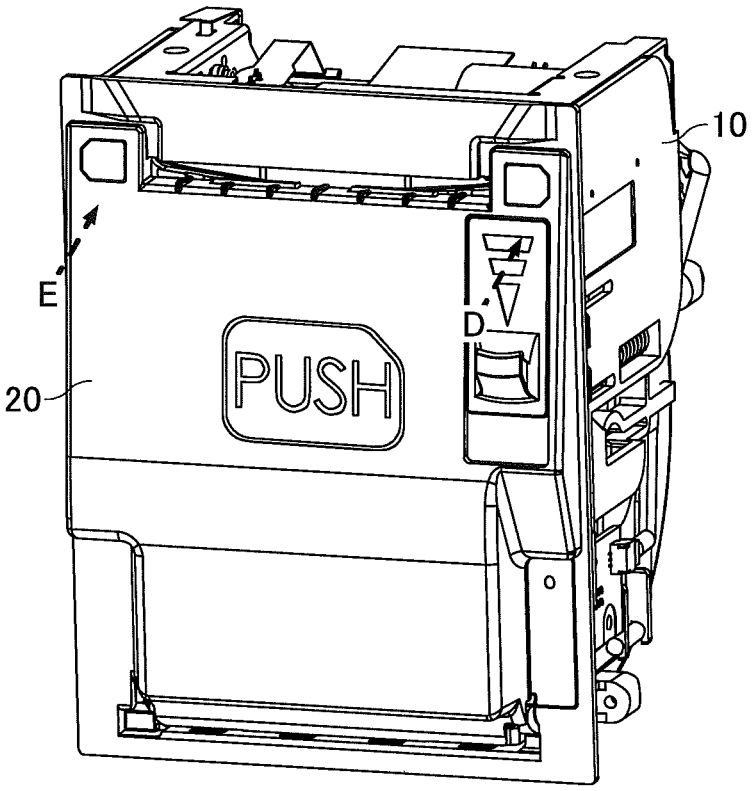
FIG. 11 is a diagram illustrating the occurrence of the half-lock state of the lid of the printer.

Referring also to FIG. 11, the first half-lock state depicted in FIGS. 9A through 9C may occur when the lid 20 is pressed only on the right side to be closed as indicated by the dashed arrow D. The second half-lock state depicted in FIGS. 10A through 10C may occur when the lid 20 is pressed only on the left side to be closed as indicated by the dashed arrow E.

[a] First Embodiment

Figure 12:
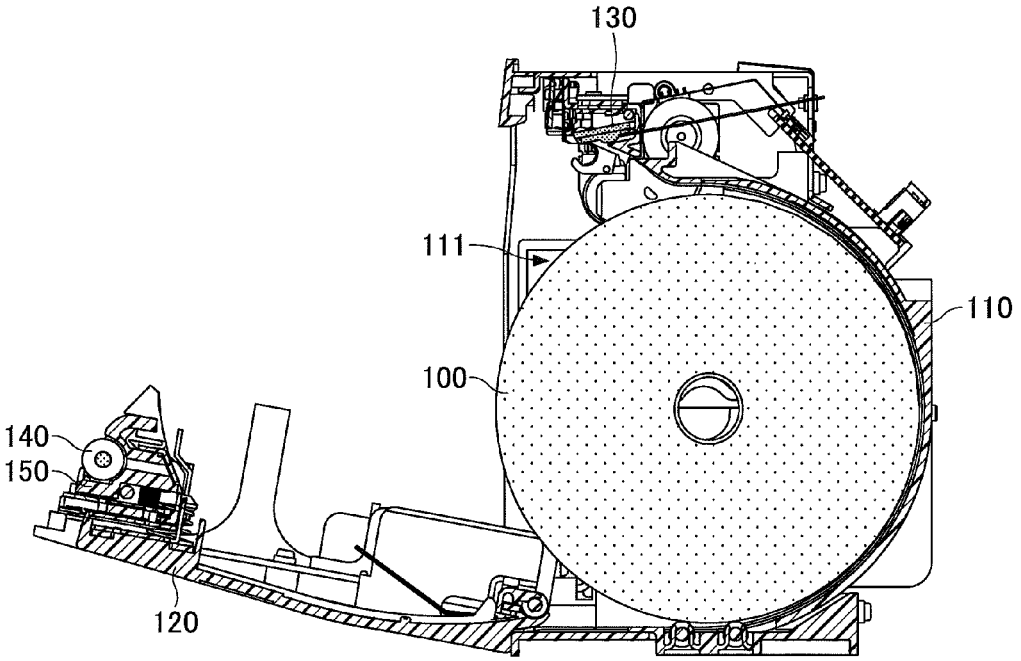
FIG. 12 is a cross-sectional view of a printer with a lid open according to a first embodiment.
Figure 13:
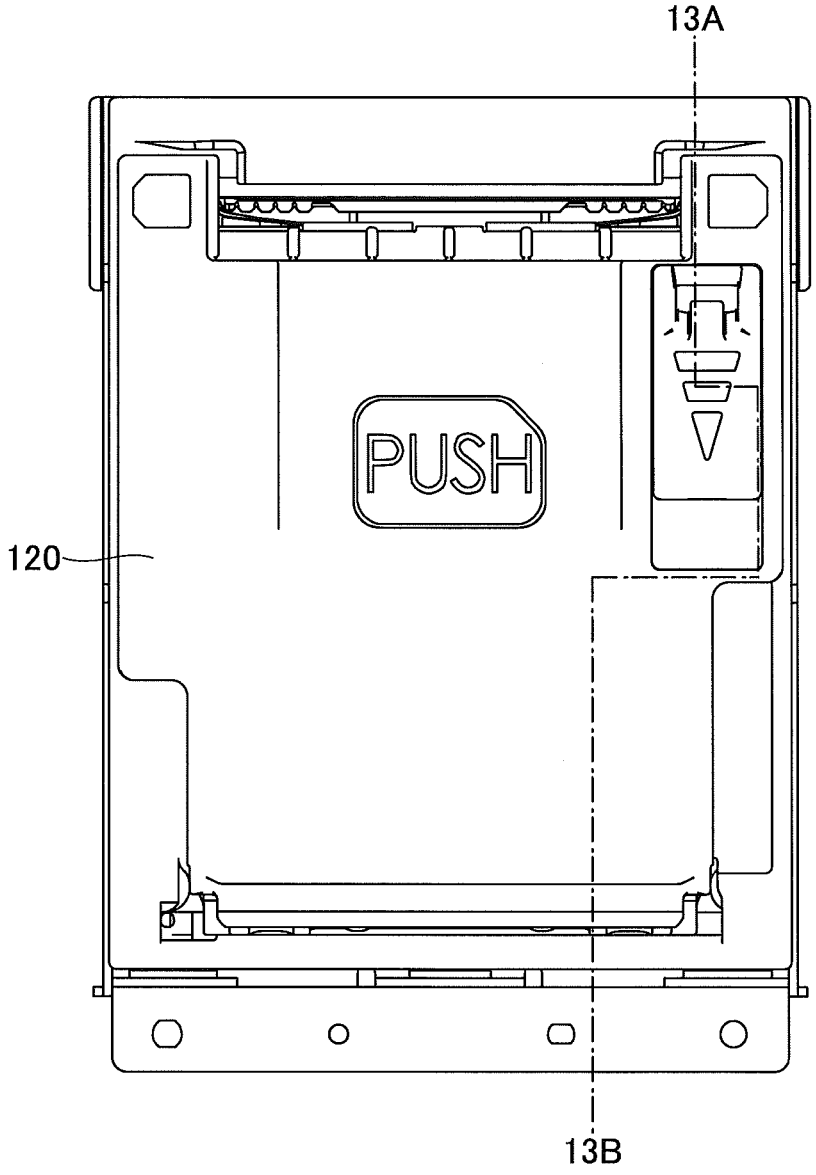
FIG. 13 is a front elevational view of the printer according to the first embodiment.
Figure 14:
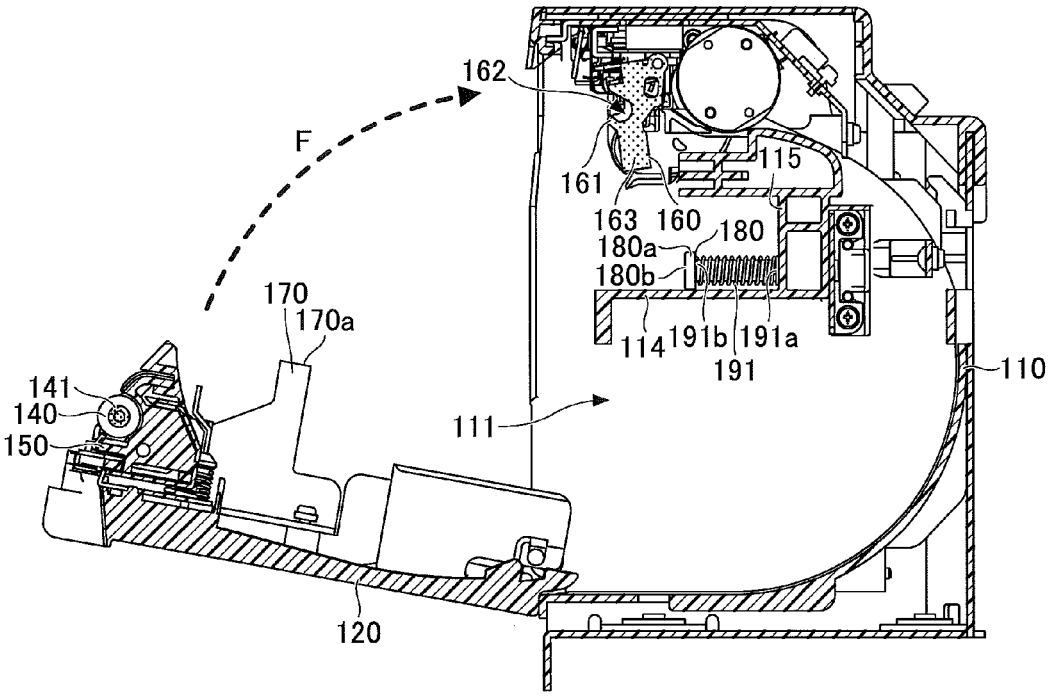
FIG. 14 is a diagram illustrating the printer according to the first embodiment.
Figure 15:
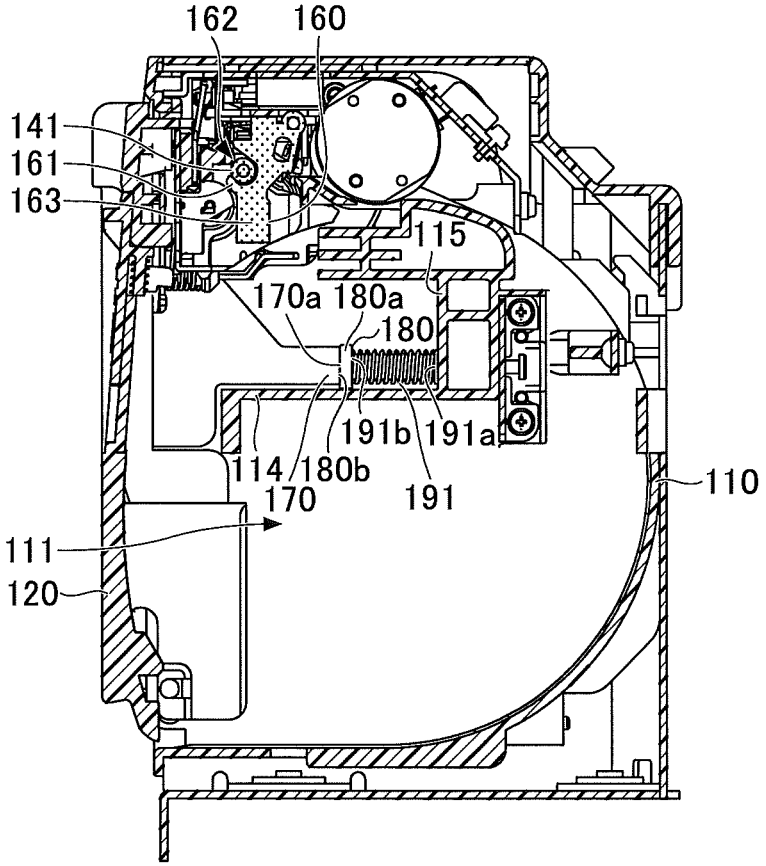
FIG. 15 is a diagram illustrating the printer according to the first embodiment.

Next, a printer according to a first embodiment is described with reference to FIGS. 12 through 18F. The printer of this embodiment is a clamshell type. FIG. 12 is a perspective view of the printer with a lid open. FIG. 13 is a front elevational view of the printer with the lid closed. FIGS. 14 and 15 are cross-sectional views of the printer taken along the one-dot chain line 13A-13B in FIG. 13, depicting a state where the lid is open and a state where the lid is closed, respectively.

The printer according to this embodiment includes a body 110 and a lid 120 pivotably attached to the body 110 to be openable and closable relative to the body 110.

The body 110 includes a holder 111, a head 130 for printing on recording paper, a control circuit board, and motors. The head 130 is a thermal head. The holder 111 is configured to accommodate the roll of recording paper 100, which is thermal paper according to this embodiment. The motors include a motor for driving a platen roller 140 to convey recording paper and a motor for driving a cutter unit 150 to cut the recording paper 100.

Figure 18A:
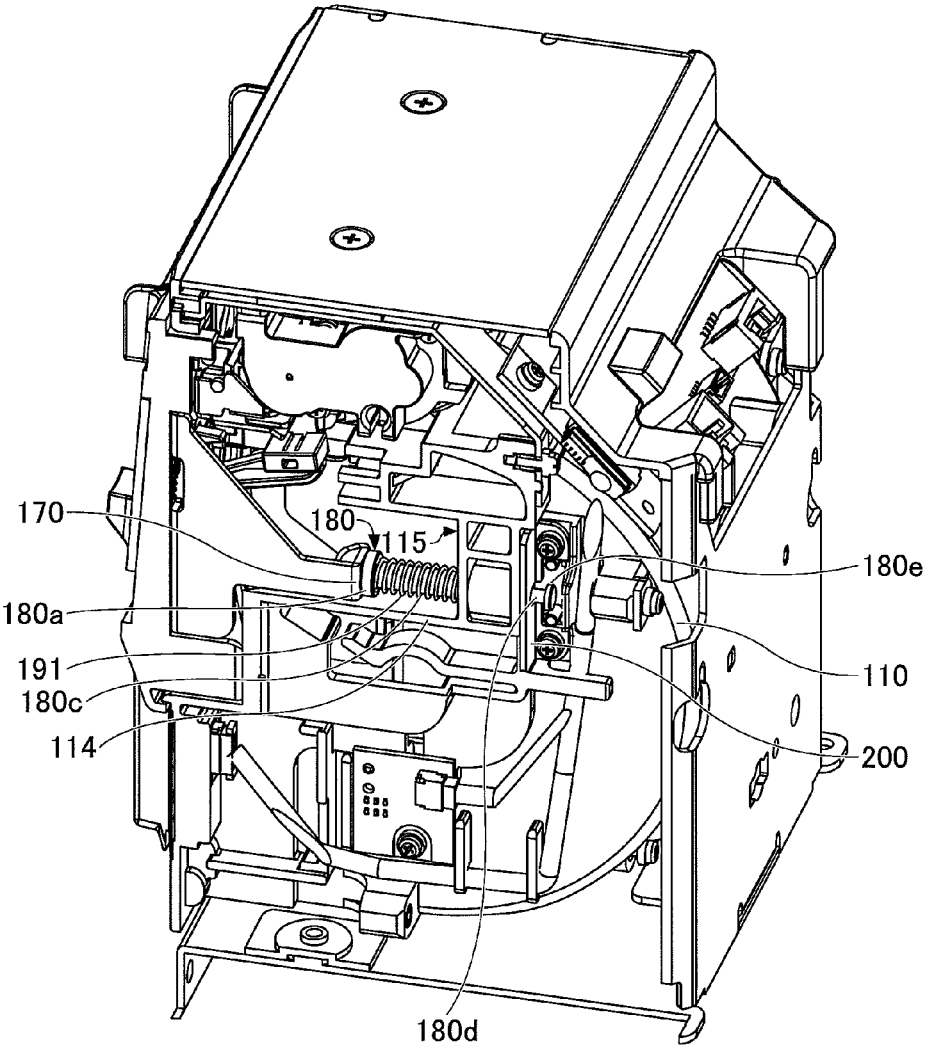
FIG. 18A is a perspective cross-sectional view of the printer according to the first embodiment.
Figure 18B:
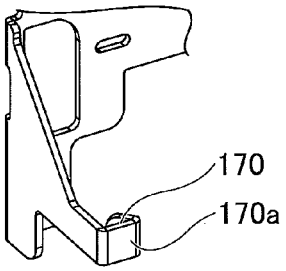
FIG. 18B is a perspective view of a pressing part of the printer according to the first embodiment.
Figure 18C:
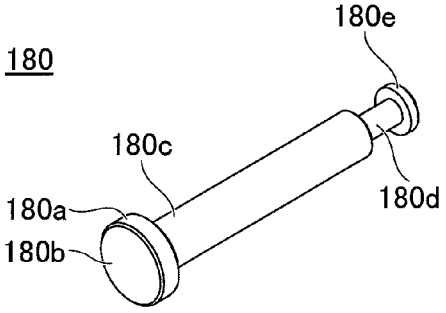
FIG. 18C is a perspective view of a movable shaft of the printer according to the first embodiment.
Figure 18D:
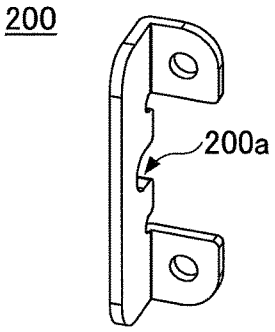
FIG. 18D is a perspective view of a stopper of the printer according to the first embodiment.
Figure 18E:
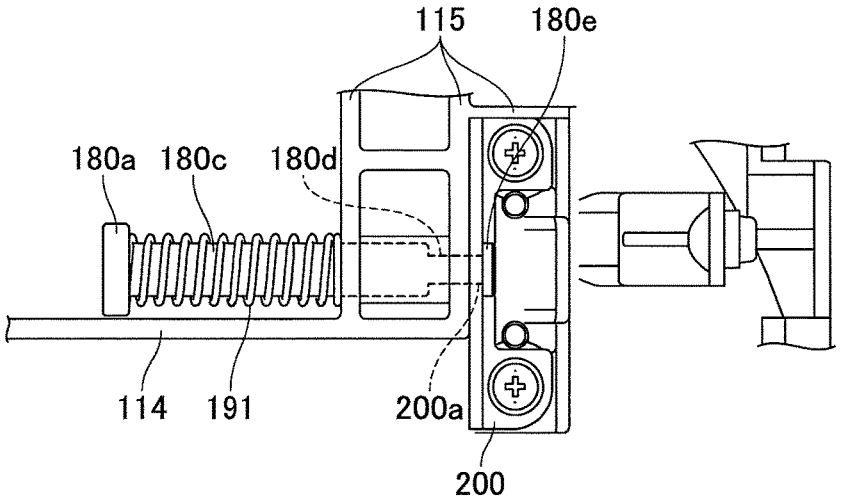
FIGS. 18E and 18F are diagrams for illustrating the movement of the movable shaft according to the first embodiment.
Figure 18F:
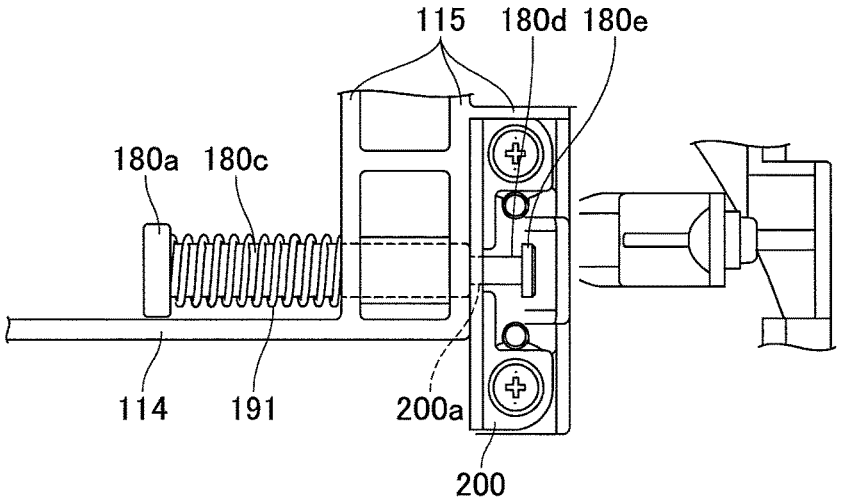

Referring also to FIGS. 18A through 18F, a pressing part 170 protruding toward the holder 111 is provided on the lid 120. A movable shaft 180 and a coil spring 191 are provided at a position corresponding to the pressing part 170 in the body 110. The movable shaft 180 and the coil spring 191 are placed on a support 114 formed in the body 110. The movable shaft 180 is provided through an opening in a wall 115 provided in the body 110 to partly project from the wall 115. The movable shaft 180 includes a thick portion 180*a* at a first longitudinal end, a flange 180*e* at a second longitudinal end, a thin portion 180*d* extending from the flange 180*e* toward the first longitudinal end, and a shaft portion 180*c* extending between the thick portion 180*a* and the thin portion 180*d*. The thick portion 180*a* is thicker (wider) than the shaft portion 180*c*. The thin portion 180*d* is thinner (narrower) than the shaft portion 180*c* and has a predetermined length in the longitudinal direction of the movable shaft 180. The shaft portion 180*c* is inserted into the coil spring 191. Part of the thin portion 180*d* is positioned in a slit 200*a* of a stopper 200 attached to the wall 115. By way of example, the stopper 200 is screwed to the wall 115 according to this embodiment. The movable shaft 180 is movable in its longitudinal direction for the length of the thin portion 180*d* minus the thickness of the stopper 200 as depicted in FIGS. 18E and 18F. FIG. 18A is a perspective cross-sectional view of the printer with the lid 120 closed. FIG. 18B is a perspective view of the pressing part 170. FIG. 18C is a perspective view of the movable shaft 180. FIG. 18D is a perspective view of the stopper 200. FIGS. 18E and 18F are diagrams for illustrating the movement of the movable shaft 180, depicting the state where the movable shaft 180 projects most from the wall 115 and the state where the movable shaft 180 is pressed and retracted most into the wall 115, respectively. For example, when the lid 120 is open, the movable shaft 180 is not pressed by the pressing part 170 to be in the state depicted in FIG. 18E. In this state, the flange 180*e* contacts the stopper 200 to prevent the movable shaft 180 to project further from the wall 115. For example, when the lid 120 is closed, the movable shaft 180 is pressed by the pressing part 170 to be in the state depicted in FIG. 18F.

A first end 191*a* of the coil spring 191 contacts a surface of the wall 115. A second end 191*b* of the coil spring 191 contacts an inner surface of the thick portion 180*a*. The pressing part 170 and the movable shaft 180 are formed of a metal material such as stainless steel. When closing the lid 120 or when the lid 120 is closed, an outer surface 180*b* of the thick portion 180*a* contacts an end surface 170*a* of the pressing part 170.

A lever 160 configured to support bearings 141 of the platen roller 140 when the lid 120 is closed is provided in the body 110. The lever 160 includes right and left locks at opposite ends. An opening that accommodates one of the bearings 141 is formed in the right lock. An opening that accommodates the other of the bearings 141 is formed in the left lock. The lever 160 is supported to be pivotable about a shaft, and is urged by a spring or the like in a direction to move the locks toward the bearings 141. The lever 160 includes an operation part 163 at the same end as the right lock. The operation part 163 is operated to pivot the lever 160. In the following, for convenience of description, the right-side portion of the lever 160 is described, referring to the right lock as "lock 161" and to the opening formed in the right lock as "opening 162."

Figure 16:
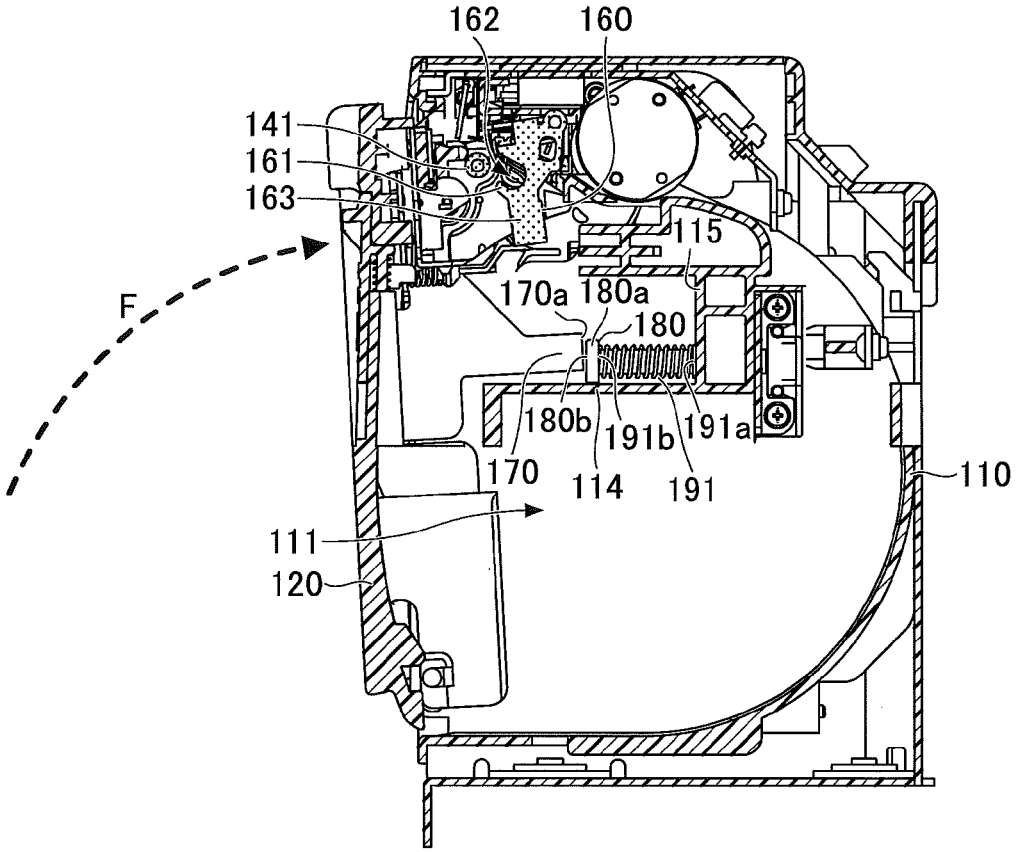
FIG. 16 is a diagram illustrating the printer according to the first embodiment.

Referring to FIG. 14, when closing the lid 120, the lid 120 that is open is pivoted with a hand in the direction indicated by the dashed arrow F, namely, clockwise. As a result, as depicted in FIG. 16, the end surface 170*a* of the pressing part 170 and the outer surface 180*b* of the movable shaft 180 come into contact. In this state, the bearing 141 (one of the bearings 141 corresponding to the lock 161) of the platen roller 140 is out of contact with the lever 160.

Figure 17:
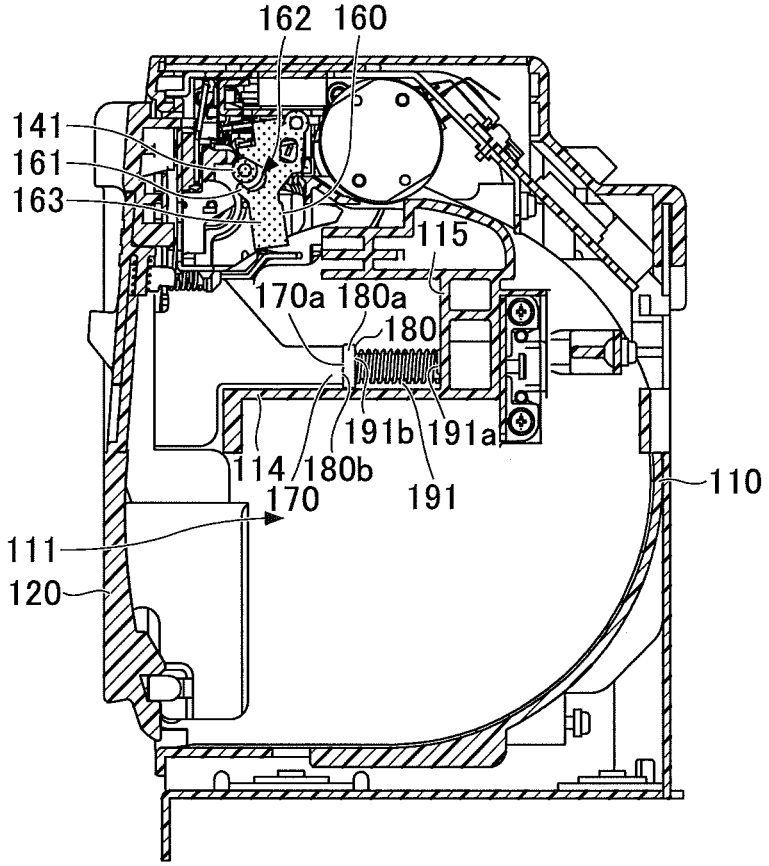
FIG. 17 is a diagram illustrating the printer according to the first embodiment.

Referring to FIG. 17, when the lid 120 is further pivoted clockwise, the pressing part 170 presses the outer surface 180*b* to move the movable shaft 180 in its longitudinal direction, and the coil spring 191 is pressed by the thick portion 180*a* to be compressed. As a result, the lid 120 is urged in a direction to be opened, and a spring force is generated. In this state, the bearing 141 is about to enter but is not completely accommodated in the opening 162. Thus, the spring force of the coil spring 191 is greater than a force for locking the bearing 141 to prevent the bearing 141 from disengaging from the lock 161. Therefore, if the hand is taken off the lid 120 in this state, a force to pivot the lid 120 in a counterclockwise direction opposite to the direction indicated by the dashed arrow F (FIG. 16) is exerted by the spring force of the coil spring 191. Thus, in the half-lock state where at least one of the bearings 141 is not accommodated in one of the openings 162, the lid 120 is opened by the spring force of the coil spring 191.

When the lid 120 is further pivoted clockwise from the position depicted in FIG. 17, the movable shaft 180 moves in its longitudinal direction to further compress the coil spring 191. As a result, the lid 120 is completely closed as depicted in FIG. 15. In this state, the bearing 141 is accommodated in the opening 162, and the bearings 141 at the right and left ends of the platen roller 140 are locked by the locks 161 at the right and left ends of the lever 160. In this state, a force to lock the bearings 141 to prevent the bearings 141 from disengaging from the locks 161 is greater than the spring force of the coil spring 191. Therefore, even when the hand is taken off the lid 120, the lid 120 is prevented from being opened by the spring force of the coil spring 191 because the bearings 141 are locked by the locks 161.

According to the printer of this embodiment, the half-lock state occurs when one of the bearings 141 is not accommodated in one of the openings 162 as depicted in FIG. 17 although the other of the bearings 141 is accommodated in the other of the openings 162. In this state, the bearings 141 of the platen roller 140 are not locked by the locks 161, and the spring force of the coil spring 191 is greater than a force of the locks 161 to lock the bearings 141. Therefore, when a hand with which the lid 120 is pivoted is taken off the lid 120, the spring force of the coil spring 191 opens the lid 120.

That is, according to the printer of this embodiment, when one of the bearings 141 is not locked, the spring force of the coil spring 191 opens the lid 120. In other words, according to the printer of this embodiment, the lid 120 is either closed as depicted in FIG. 15 or open as depicted in FIG. 14, and no half-lock state occurs.

Figure 19:
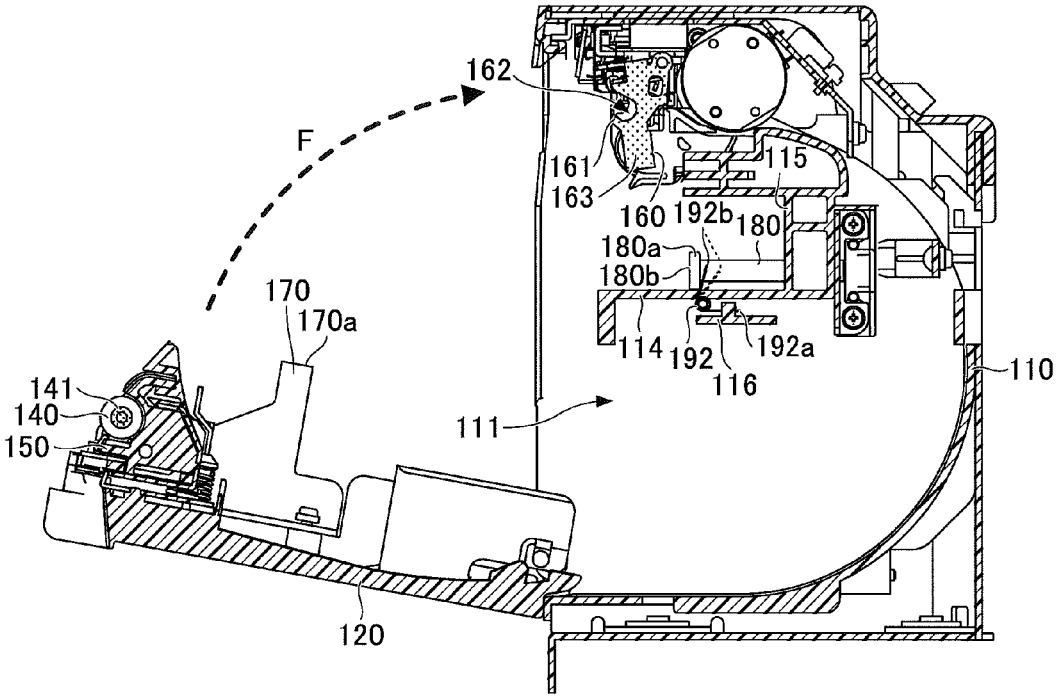
FIG. 19 is a cross-sectional view of a first variation of the printer according to the first embodiment.

As depicted in FIG. 19, a helical torsion spring 192 may be used instead of the coil spring 191. A first arm 192*a* of the helical torsion spring 192 is fixed to a spring fixation part 116 provided in the body 110. A second arm 192*b* of the helical torsion spring 192 contacts the inside of the thick portion 180*a*. When the movable shaft 180 is pressed by the pressing part 170, the helical torsion spring 192 is pressed by the inside of the thick portion 180*a* to deform as indicated by the dashed line to generate a spring force in a direction to open the lid 120.

Figure 20:
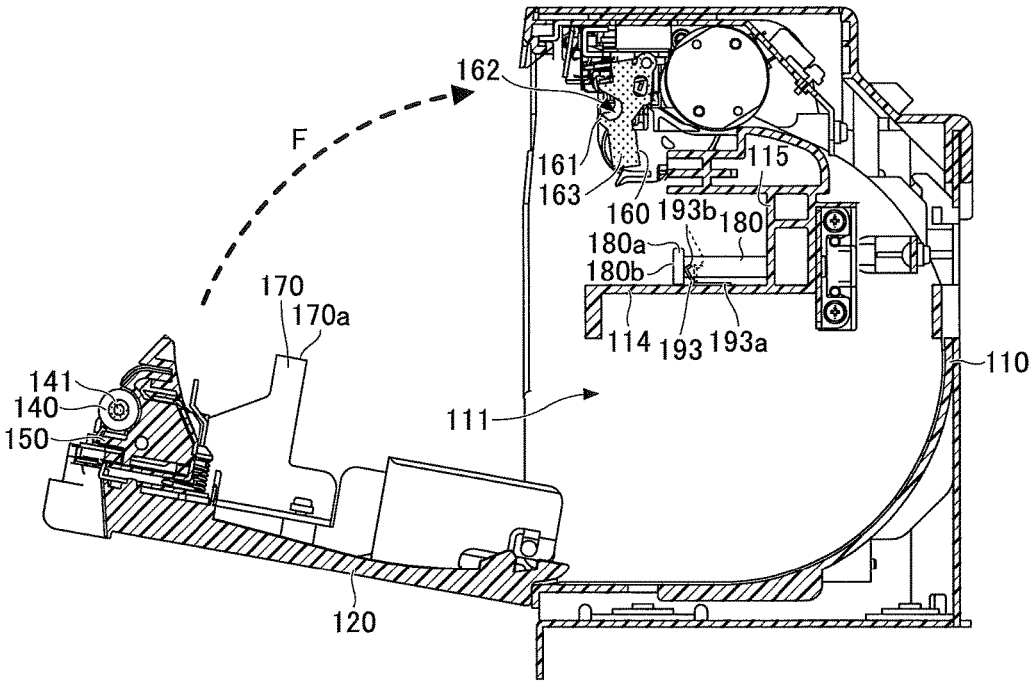
FIG. 20 is a cross-sectional view of a second variation of the printer according to the first embodiment.

Alternatively, as depicted in FIG. 20, a leaf spring 193 may be used instead of the coil spring 191. A first end portion 193*a* of the leaf spring 193 is fixed to the support 114 provided in the body 110. A second end portion 193*b* of the leaf spring 193 contacts the inside of the thick portion 180*a*. When the movable shaft 180 is pressed by the pressing part 170, the leaf spring 193 is pressed by the inside of the thick portion 180*a* to deform as indicated by the dashed line to generate a spring force in a direction to open the lid 120.

Figure 21:
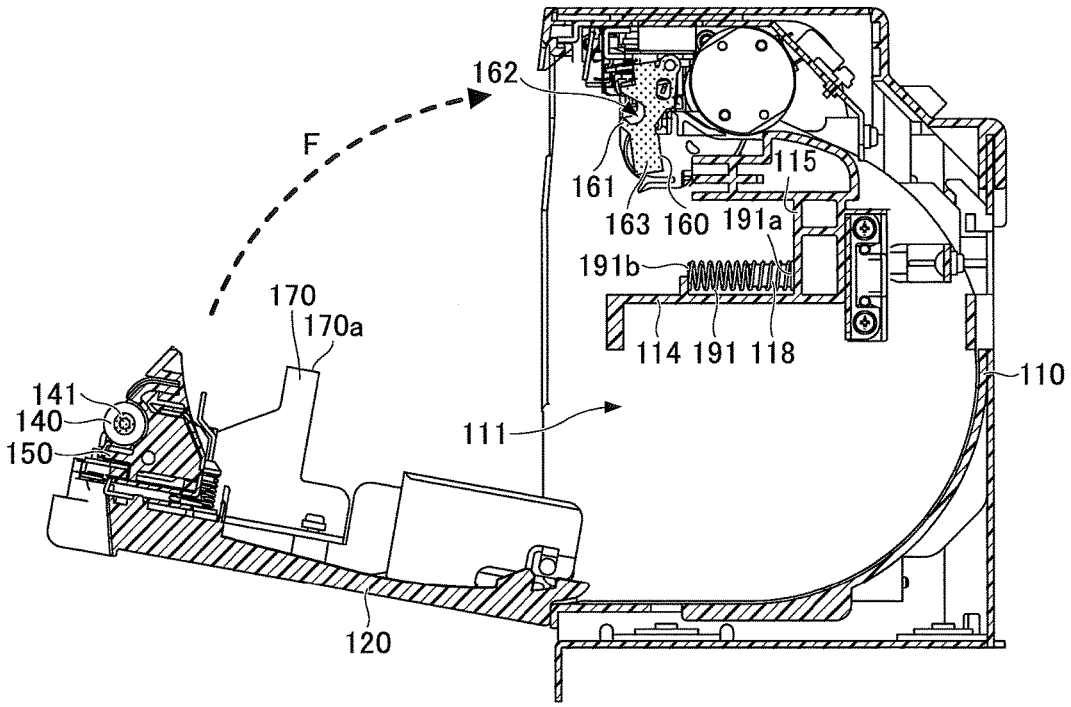
FIG. 21 is a cross-sectional view of a third variation of the printer according to the first embodiment.

As another alternative, the printer of this embodiment may omit the movable shaft 180. Referring to FIG. 21, a projection 118 in the surface of the wall 115 is inserted into the coil spring 191, and the first end 191*a* of the coil spring 191 contacts the surface of the wall 115. When the lid 120 is closed, the second end 191*b* of the coil spring 191 directly contacts the end surface 170*a* of the pressing part 170 to be pressed by the end surface 170*a* to generate a spring force in the coil spring 191.

Figure 22:
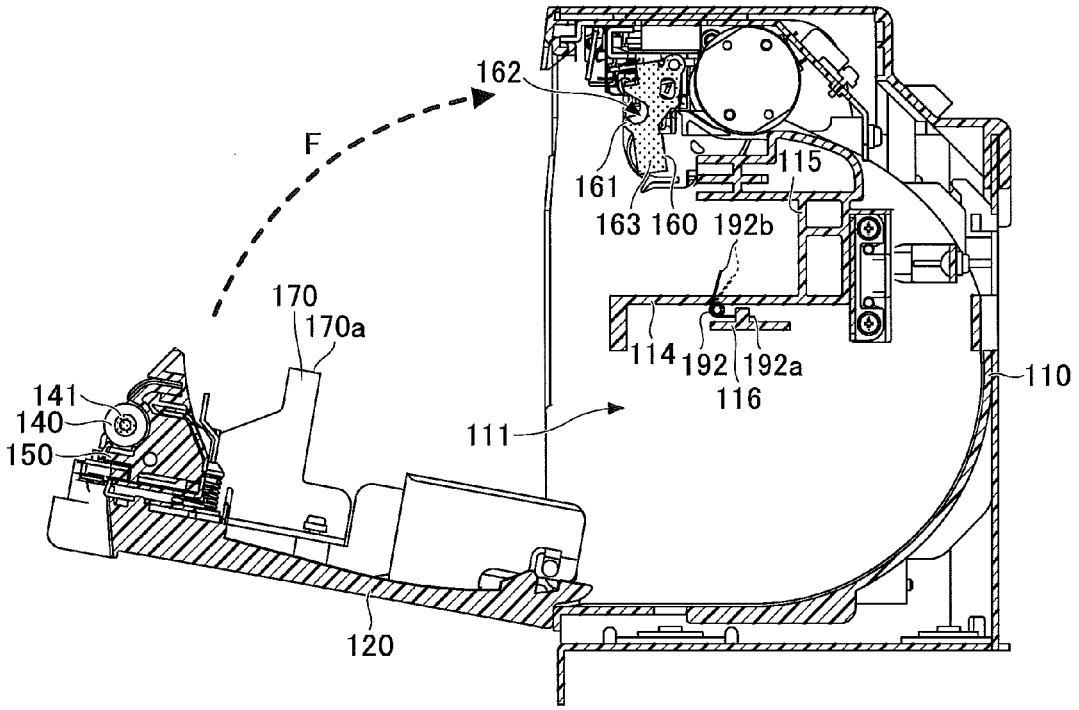
FIG. 22 is a cross-sectional view of a fourth variation of the printer according to the first embodiment.

As yet another alternative, as depicted in FIG. 22, the movable shaft 180 may be omitted in the case of using the helical torsion spring 192. In this case, when the lid 120 is closed, the second arm 192*b* of the helical torsion spring 192 directly contacts the end surface 170*a* of the pressing part 170 to be pressed by the end surface 170*a*. As a result, the second arm 192*b* deforms as indicated by the dashed line to generate a spring force in the helical torsion spring 192.

Figure 23:
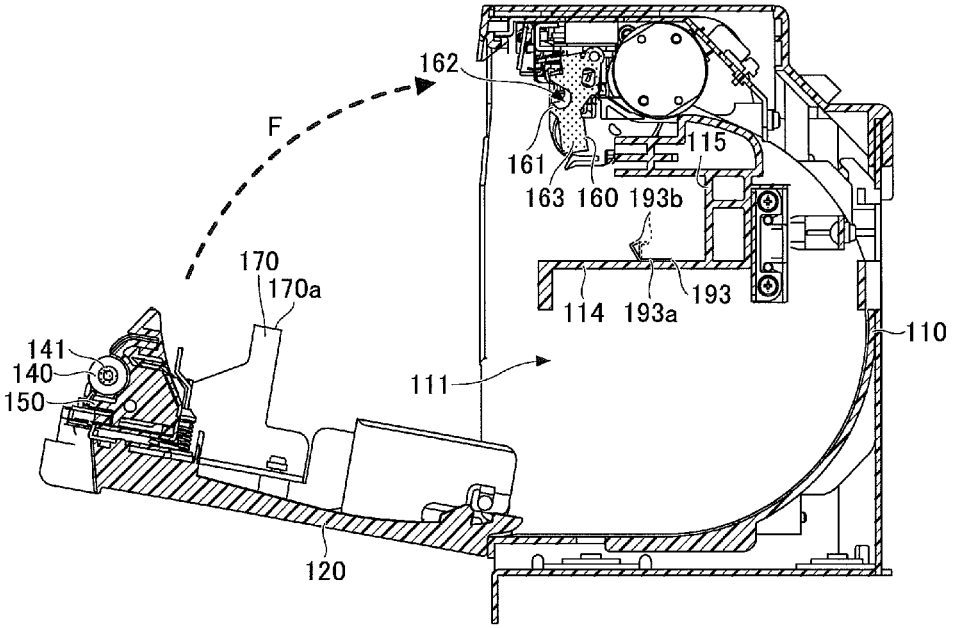
FIG. 23 is a cross-sectional view of a fifth variation of the printer according to the first embodiment.

As still another alternative, as depicted in FIG. 23, the movable shaft 180 may be omitted in the case of using the leaf spring 193. In this case, when the lid 120 is closed, the second end portion 193*b* of the leaf spring 193 directly contacts the end surface 170*a* of the pressing part 170 to be pressed by the end surface 170*a*. As a result, the second end portion 193*b* deforms as indicated by the dashed line to generate a spring force in the leaf spring 193.

In the arrangements as depicted in FIGS. 21 through 23, the stopper 200 may be omitted.

[b] Second Embodiment

Figure 24A:
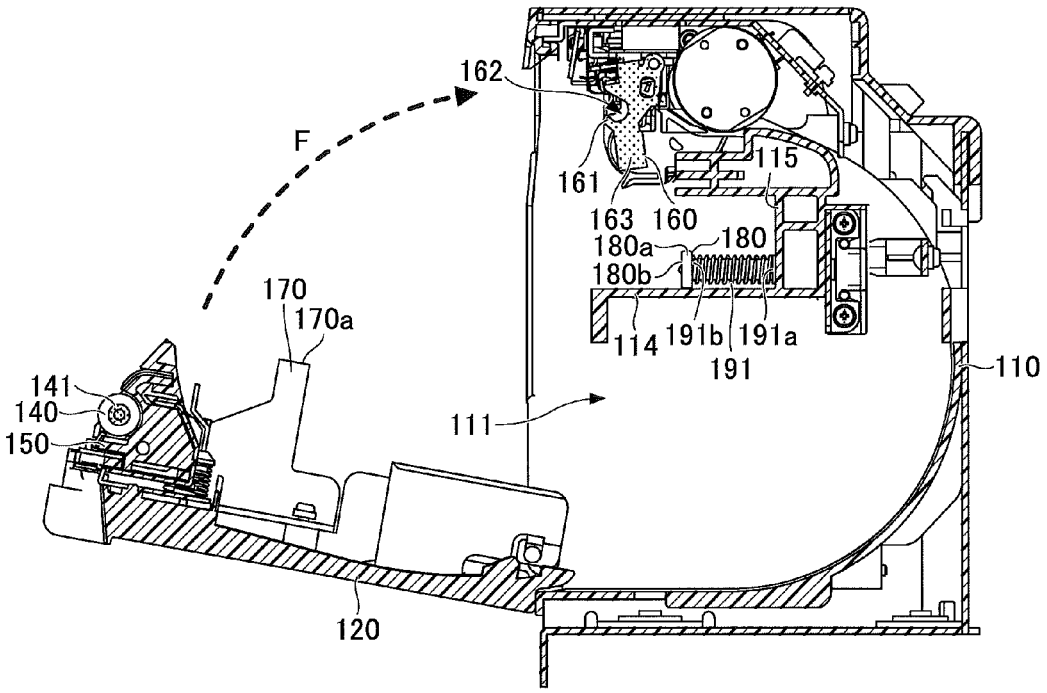
FIGS. 24A and 24B are diagrams depicting a structure of a printer according to a second embodiment.
Figure 24B:
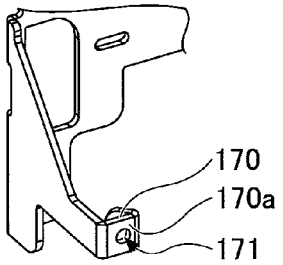
Figure 25A:
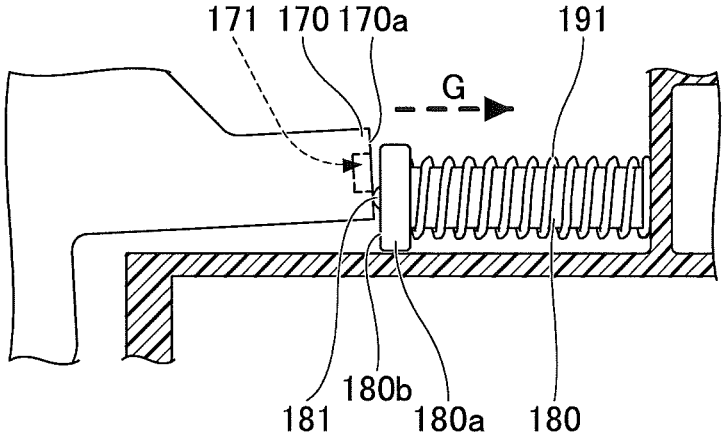
FIGS. 25A and 25B are diagrams illustrating the printer according to the second embodiment.
Figure 25B:
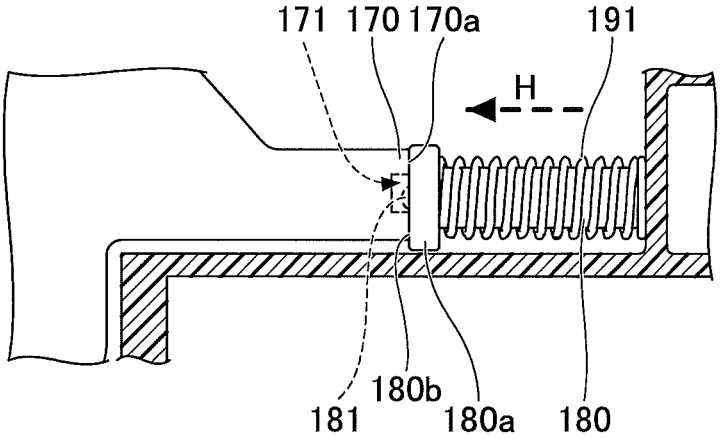

Next, a second embodiment is described with reference to FIGS. 24A, 24B, 25A and 25B. According to a printer of this embodiment, as depicted in FIGS. 25A and 25B, the outer surface 180*b* of the movable shaft 180 includes a projection 181, and the end surface 170*a* of the pressing part 170 includes an opening 171 corresponding to the projection 181. FIG. 24A is a cross-sectional view of the printer of this embodiment. FIG. 24B is a perspective view of the pressing part 170. FIG. 25A depicts a state before the projection 181 enters the opening 171. FIG. 25B depicts the state where the projection 181 is in the opening 171.

According to this embodiment, when the lid 120 is pivoted in the direction indicated by the dashed arrow F in FIG. 24A to be closed, the pressing part 170 and the movable shaft 180 contact. At this point, first, the projection 181 of the movable shaft 180 and the end surface 170*a* of the pressing part 170 contact as depicted in FIG. 25A. As the lid 120 is pivoted in the direction indicated by the dashed arrow F, the projection 181 is pressed while moving on the end surface 170*a*. As a result, the movable shaft 180 is pressed by the pressing part 170 in the direction indicated by the dashed arrow G in FIG. 25A to compress the coil spring 191.

When the lid 120 is further pivoted in the direction indicated by the dashed arrow F to relatively move the projection 181 to the position of the opening 171 provided in the end surface 170*a*, the movable shaft 180 moves in the direction indicated by the dashed arrow H in FIG. 25B because of the spring force of the coil spring 191 to have the projection 181 enter the opening 171. At this point, the end surface 170*a* and the outer surface 180*b* contact to generate an impact and an impact sound.

Thus, a user who has been closing the lid 120 can perceive the complete closure of the lid 120 tactilely and aurally through the impact and the impact sound generated by the contact of the end surface 170*a* and the outer surface 180*b*.

Figure 26A:
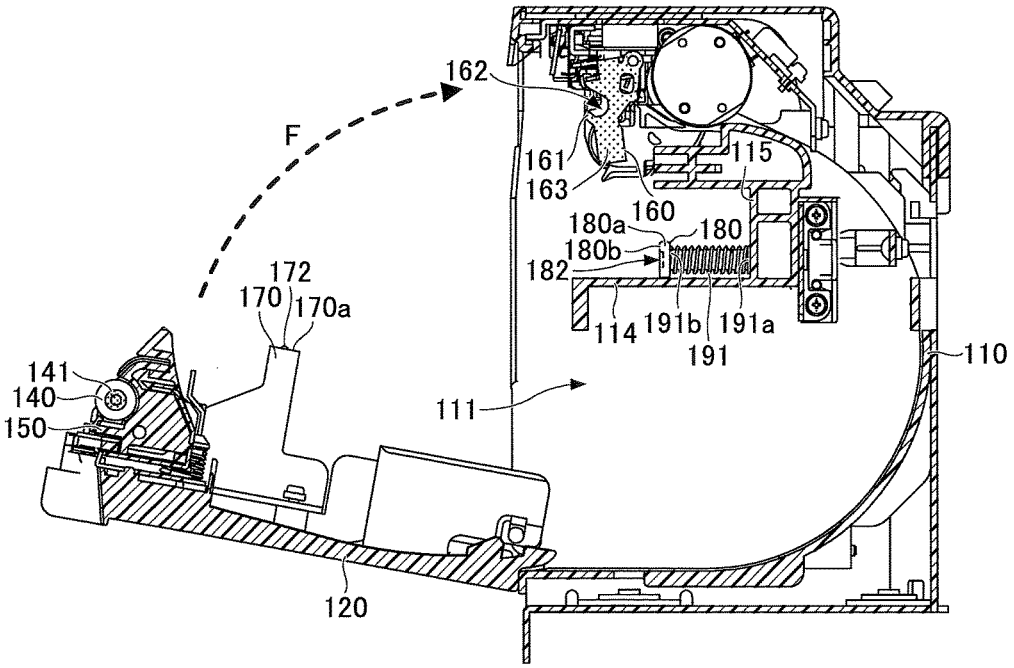
FIGS. 26A through 26C are diagrams depicting a structure of a first variation of the printer according to the second embodiment.
Figure 26B:
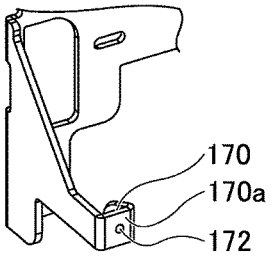
Figure 26C:
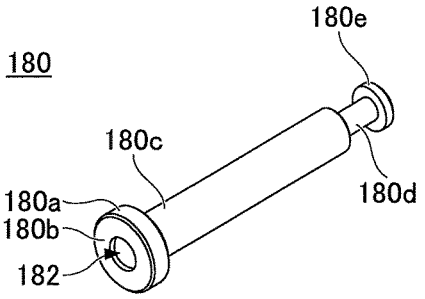
Figure 27A:
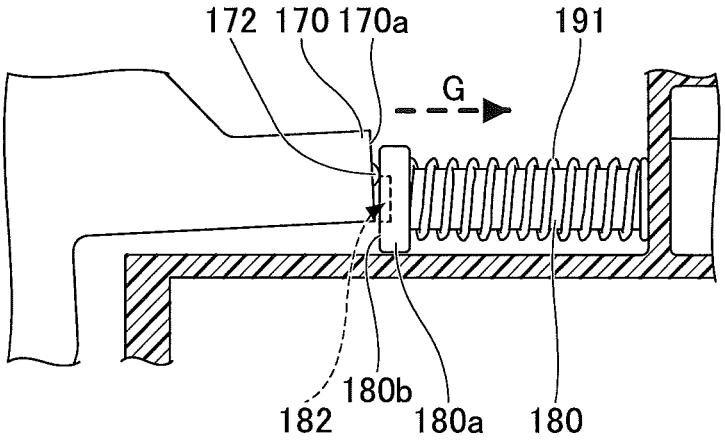
FIGS. 27A and 27B are diagrams illustrating the first variation of the printer according to the second embodiment.
Figure 27B:
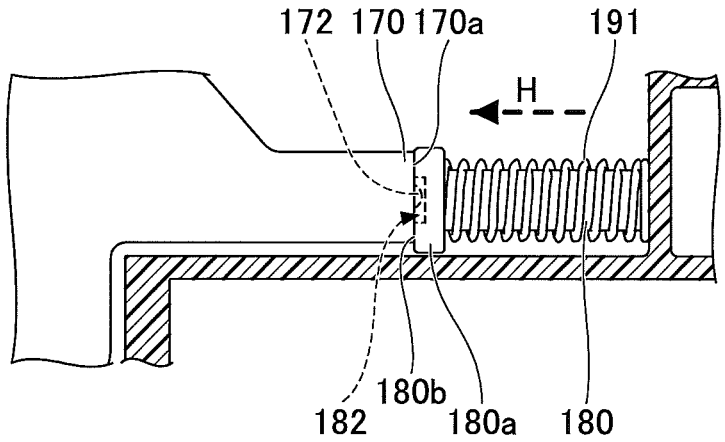

Alternatively, according to the printer of this embodiment, as depicted in FIGS. 26A, 26B, 26C, 27A and 27B, the end surface 170*a* may include a projection 172 and the outer surface 180*b* may include a circular opening 182. In this case as well, the same as described above, when the lid 120 is closed, the end surface 170*a* and the outer surface 180*b* contact because of the spring force of the coil spring 191 to generate an impact and an impact sound. A user who has been closing the lid 120 can perceive the complete closure of the lid 120 through the impact and the impact sound thus generated. FIG. 26A is a cross-sectional view of the printer. FIG. 26B is a perspective view of the pressing part 170. FIG. 26C is a perspective view of the movable shaft 180. FIG. 27A depicts a state before the projection 172 enters the opening 182. FIG. 27B depicts the state where the projection 172 is in the opening 182.

Figure 28A:
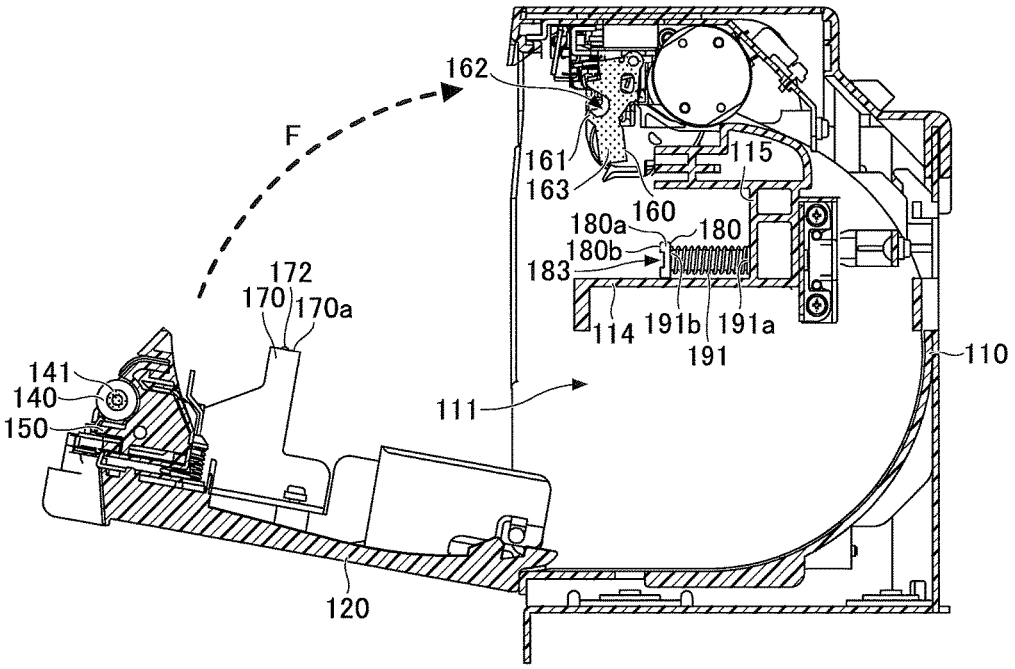
FIGS. 28A through 28C are diagrams depicting a structure of a second variation of the printer according to the second embodiment.
Figure 28B:
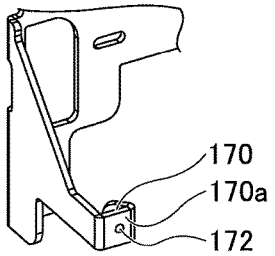
Figure 28C:
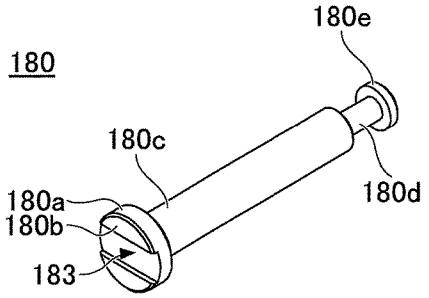
Figure 29A:
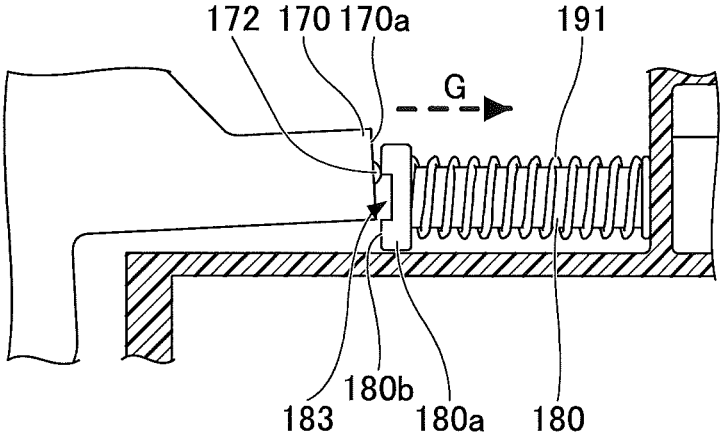
FIGS. 29A and 29B are diagrams illustrating the second variation of the printer according to the second embodiment.
Figure 29B:
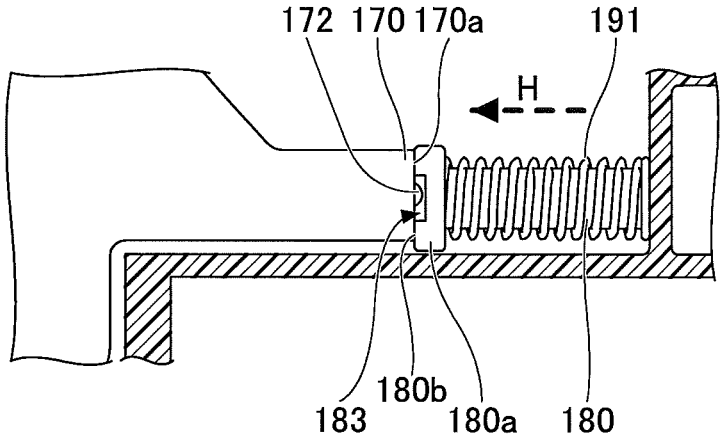

As another alternative, according to the printer of this embodiment, as depicted in FIGS. 28A, 28B, 28C, 29A and 29B, a groove 183 may be formed in the outer surface 180*b* instead of the opening 182. FIG. 28A is a cross-sectional view of the printer. FIG. 28B is a perspective view of the pressing part 170. FIG. 28C is a perspective view of the movable shaft 180. FIG. 29A depicts a state before the projection 172 enters the groove 183. FIG. 29B depicts the state where the projection 172 is in the groove 183.

Figure 30A:
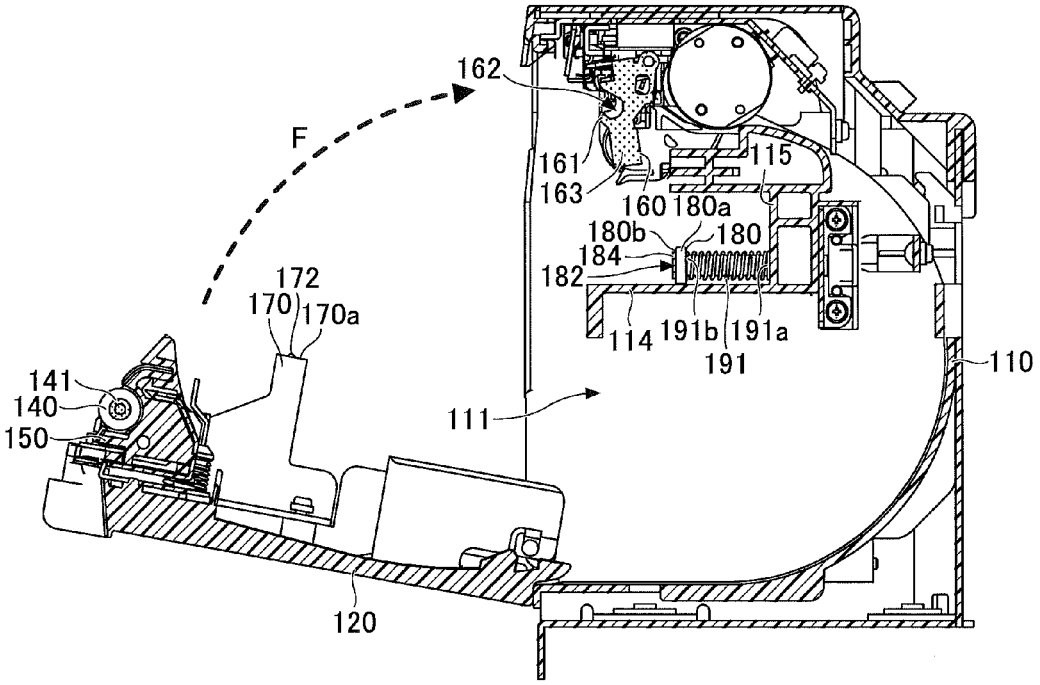
FIGS. 30A through 30C are diagrams depicting a structure of a third variation of the printer according to the second embodiment.
Figure 30B:
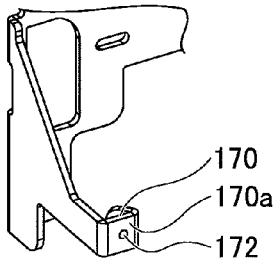
Figure 30C:
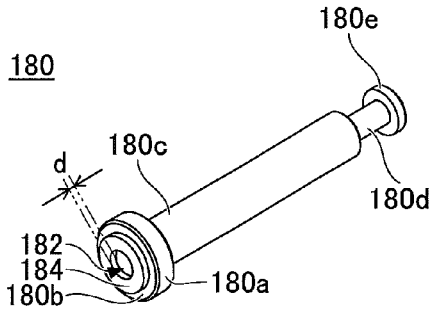
Figure 31A:
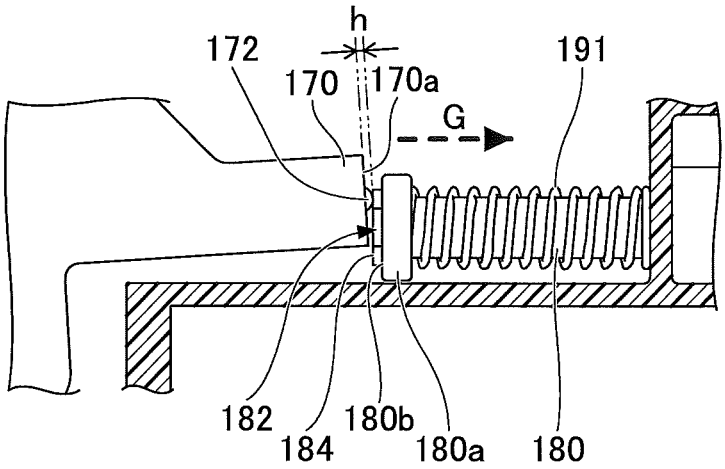
FIGS. 31A and 31B are diagrams illustrating the third variation of the printer according to the second embodiment.
Figure 31B:
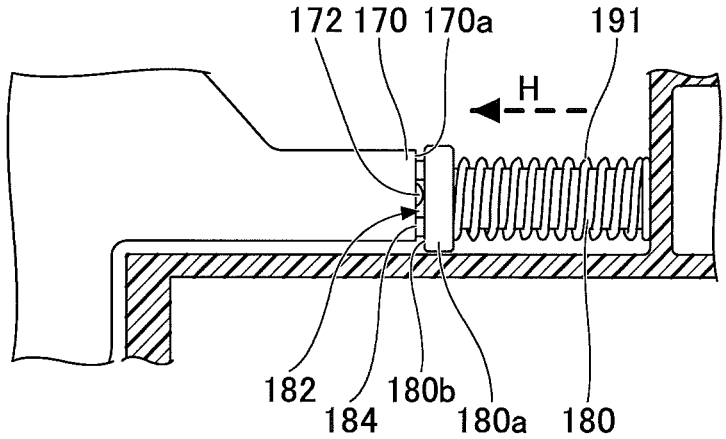

As yet another alternative, as depicted in FIGS. 30A, 30B, 30C, 31A and 31B, an annular projection 184 may be formed in the outer surface 180*b* to define the opening 182. FIG. 30A is a cross-sectional view of the printer. FIG. 30B is a perspective view of the pressing part 170. FIG. 30C is a perspective view of the movable shaft 180. FIG. 31A depicts a state before the projection 172 enters the opening 182. FIG. 31B depicts the state where the projection 172 is in the opening 182. Furthermore, according to the second embodiment, a depth d of the opening 182 (or the groove 183) and a height h of the projection 172 (or the depth of the opening 171 and the height of the projection 181) may be changed to change the magnitude of the impact and the impact sound generated by the contact of the end surface 170*a* and the outer surface 180*b* caused by the spring force of the coil spring 191. Therefore, the depth d of the opening 182 and the height h of the projection 172 may be controlled to generate an impact of a desired magnitude and an impact sound of a desired magnitude.

According to the printer of this embodiment, a helical torsion spring or a leaf spring may be used instead of the coil spring 191. In other respects than those described above, the second embodiment may be the same as the first embodiment.

[c] Third Embodiment

Figure 32:
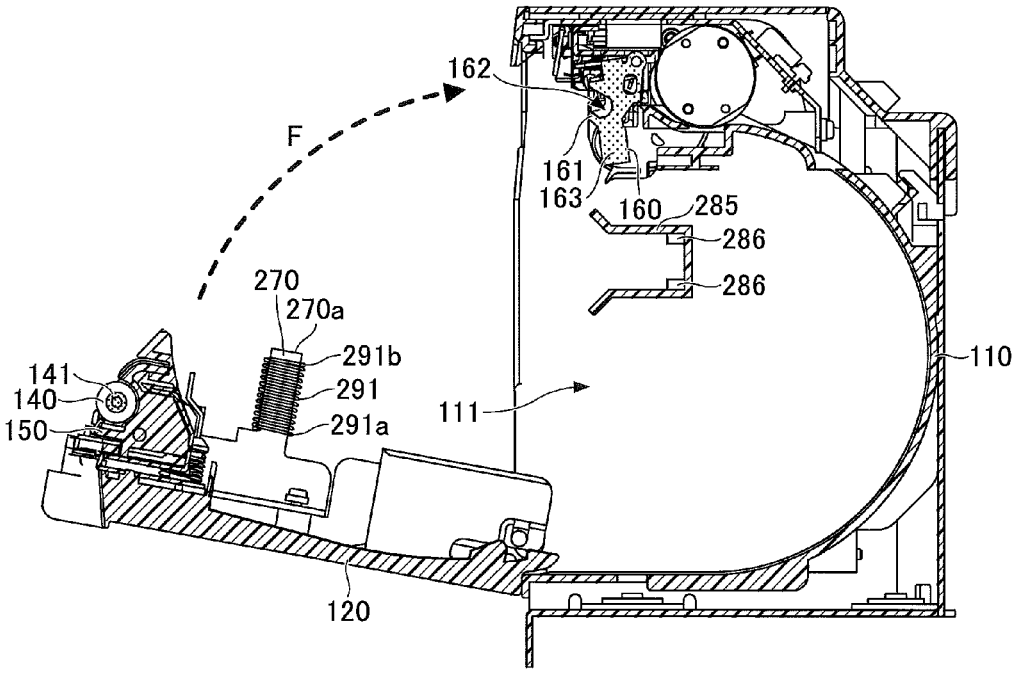
FIG. 32 is a diagram illustrating a printer according to a third embodiment.
Figure 33:
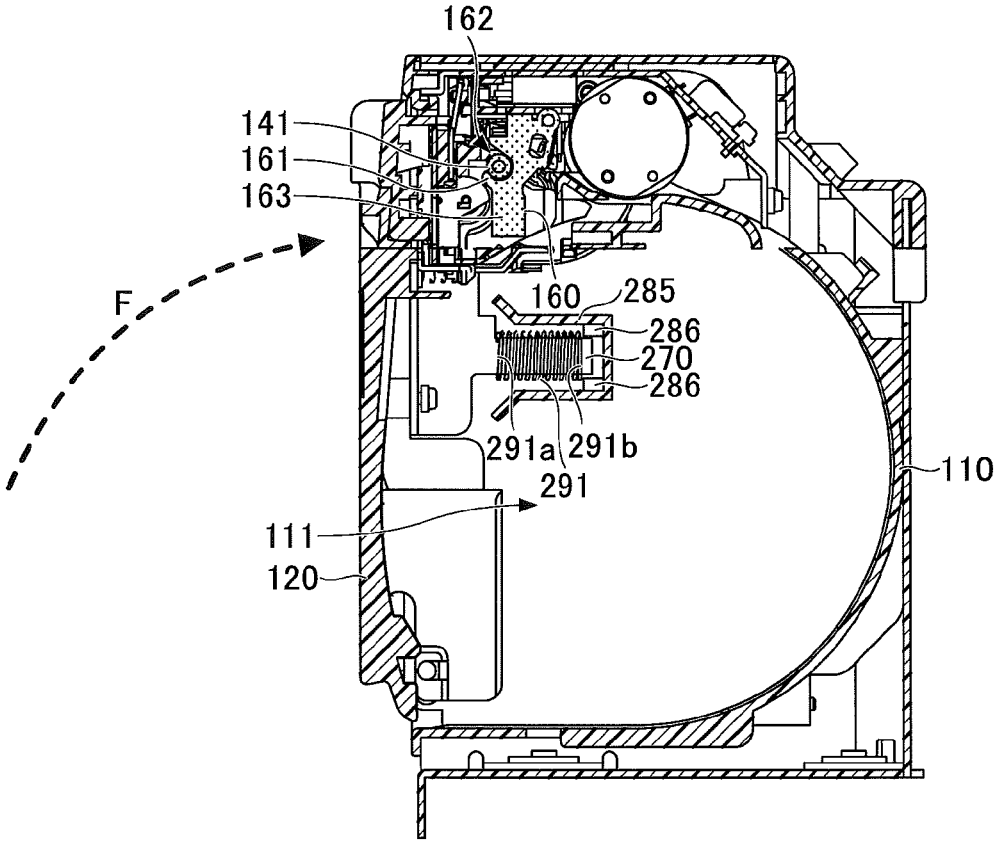
FIG. 33 is a diagram illustrating the printer according to the third embodiment.

Next, a third embodiment is described. According to a printer of this embodiment, as depicted in FIGS. 32 and 33, a coil spring 291 is provided on the lid 120, and a tubular part 285 configured to accommodate the coil spring 291 when the lid 120 is closed is provided in the body 110. Furthermore, a contact part 286 configured to contact the coil spring 291 is provided at the bottom of the tubular part 285. A projection 270 provided on the lid 120 is inserted into the coil spring 291.

A first end 291*a* of the coil spring 291 contacts part of the lid 120. A second end 291*b* of the coil spring 291 contacts the contact part 286 at the bottom of the tubular part 285 to be compressed to generate a spring force in a direction to open the lid 120, when the lid 120 is closed. Therefore, according to the printer of this embodiment, even when at least one of the bearings 141 is not accommodated in one of the openings 162, the occurrence of a half-lock state is prevented because the lid 120 is opened by the spring force of the coil spring 291.

According to the printer of this embodiment, a helical torsion spring or a leaf spring may be used instead of the coil spring 191. In other respects than those described above, the second embodiment may be the same as the first embodiment.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer comprising:

a body configured to accommodate recording paper;

a lid attached to the body to be openable and closable relative to the body;

a pressing part on the lid;

a platen roller attached to the lid;

a movable shaft in the body, provided at a position corresponding to the pressing part to be movable in a longitudinal direction of the movable shaft;

a spring that urges the movable shaft; and a lever configured to support bearings of the platen roller with the lid being closed, wherein the movable shaft is pressed by the pressing part to generate a spring force in the spring during closure of the lid.

2. The printer as claimed in claim 1, wherein the movable shaft includes a first surface that contacts the pressing part, the first surface including a projection, the pressing part includes a second surface that contacts the movable shaft, the second surface including an opening, and the projection enters the opening during the closure of the lid.

3. The printer as claimed in claim 1, wherein the pressing part includes a first surface that contacts the movable shaft, the first surface including a projection, the movable shaft includes a second surface that contacts the pressing part, the second surface including an opening or a groove, and the projection enters the opening or the groove during the closure of the lid.

4. A printer comprising:

a body configured to accommodate recording paper;

a lid attached to the body to be openable and closable relative to the body;

a platen roller attached to the lid;

a lever configured to support bearings of the platen roller with the lid being closed;

a spring in the body; and a pressing part on the lid, provided at a position corresponding to the spring, wherein the spring is pressed by the pressing part to generate a spring force during closure of the lid.

5. The printer as claimed in claim 4, wherein the spring includes a first part connected to the body and a second part that is pressed by the pressing part during the closure of the lid.

6. A printer comprising:

a body configured to accommodate recording paper;

a lid attached to the body to be openable and closable relative to the body;

a platen roller attached to the lid;

a lever configured to support bearings of the platen roller with the lid being closed; and a spring on the lid, the spring including a first part connected to the lid, wherein the body includes a contact part provided at a position corresponding to a second part of the spring, and the second part of the spring is pressed by the contact part to generate a spring force during closure of the lid.

7. The printer as claimed in claim 6, wherein the body includes a tubular part configured to accommodate the spring, and the contact part is provided at a bottom of the tubular part.

* * * * *